US009078491B2

(12) United States Patent
Cook

(10) Patent No.: US 9,078,491 B2
(45) Date of Patent: Jul. 14, 2015

(54) IMPACT-ATTENUATING ELEMENTS REMOVABLY MOUNTED IN FOOTWEAR OR OTHER PRODUCTS

(75) Inventor: Christopher S. Cook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1067 days.

(21) Appl. No.: 13/004,689

(22) Filed: Jan. 11, 2011

(65) Prior Publication Data

US 2012/0090200 A1 Apr. 19, 2012

Related U.S. Application Data

(60) Continuation-in-part of application No. 12/465,546, filed on May 13, 2009, now Pat. No. 8,006,408, which is a division of application No. 10/997,981, filed on Nov. 29, 2004, now abandoned.

(51) Int. Cl.

| | |
|---|---|
| ***A43B 3/24*** | (2006.01) |
| ***A43B 1/00*** | (2006.01) |
| ***A43B 3/00*** | (2006.01) |

(Continued)

(52) U.S. Cl.

CPC ..... *A43B 3/24* (2013.01); *A43B 1/0081* (2013.01); *A43B 3/0031* (2013.01); *A43B 3/246* (2013.01); *A43B 7/144* (2013.01); *A43B 7/148* (2013.01); *A43B 7/1465* (2013.01); *A43B 21/26* (2013.01); *A43B 21/36* (2013.01); *A43B 21/37* (2013.01);

(Continued)

(58) Field of Classification Search

CPC ..... A43B 3/246
USPC ..... 12/142 P; 36/15, 100, 103, 28
See application file for complete search history.

(56) References Cited

U.S. PATENT DOCUMENTS

| | | | |
|---|---|---|---|
| 1,516,384 | A | 11/1924 | Kamada |
| 2,932,099 | A | 4/1960 | Dardig |

(Continued)

FOREIGN PATENT DOCUMENTS

| | | |
|---|---|---|
| WO | 96/13995 | 5/1996 |

OTHER PUBLICATIONS

International Search Report issued in International Application No. PCT/US2005/038941, on Feb. 14, 2006 (related to the parent application).

(Continued)

*Primary Examiner* — Ted Kavanaugh
(74) *Attorney, Agent, or Firm* — Banner & Witcoff, Ltd.

(57) ABSTRACT

Articles of footwear have a sole structure that extends along the longitudinal length of the article of footwear within the forefoot region, the midfoot region, and the heel region of the article of footwear. One or more removable inserts may be inserted into at least a portion of the sole structure in any desired region. Various removable inserts may have different characteristics, including different performance characteristics. The various removable inserts may be inserted into and removed from the sole structure of the article of footwear. A wearer may be able to compare the characteristics for each of the removable inserts. Such a process may help a wearer to determine the more favorable characteristics for an article of footwear; may facilitate testing of sole structures or other components of an article of footwear for a manufacturer or developer of articles of footwear; may help train wearers who test the articles of footwear for such a manufacturer or developer; may improve versatility of a single article of footwear; and the like.

39 Claims, 18 Drawing Sheets

(51) Int. Cl.

| | |
|---|---|
| ***A43B 7/14*** | (2006.01) |
| ***A43B 21/26*** | (2006.01) |
| ***A43B 21/36*** | (2006.01) |
| ***A43B 21/37*** | (2006.01) |
| ***A43B 21/46*** | (2006.01) |
| ***A43B 21/48*** | (2006.01) |
| ***A43B 21/50*** | (2006.01) |

(52) U.S. Cl.
CPC ..... *A43B 21/46* (2013.01); *A43B 21/48* (2013.01); *A43B 21/50* (2013.01)

(56) References Cited

U.S. PATENT DOCUMENTS

| | | | | | |
|---|---|---|---|---|---|
| 3,063,168 | A | | 11/1962 | Cortina | |
| 3,886,674 | A | | 6/1975 | Pavia | |
| 4,364,189 | A | * | 12/1982 | Bates | 36/31 |
| 4,698,923 | A | | 10/1987 | Arf | |
| 4,942,677 | A | | 7/1990 | Flemming et al. | |
| 5,410,821 | A | | 5/1995 | Hilgendorf | |
| 5,615,497 | A | | 4/1997 | Meschan | |
| 5,797,199 | A | | 8/1998 | Miller et al. | |
| 5,799,417 | A | | 9/1998 | Burke et al. | |
| 6,023,859 | A | | 2/2000 | Burke et al. | |
| 6,813,847 | B2 | | 11/2004 | Workman | |
| 6,968,636 | B2 | | 11/2005 | Aveni et al. | |
| 7,331,123 | B2 | | 2/2008 | Workman et al. | |
| 7,520,069 | B2 | | 4/2009 | Workman et al. | |
| 2001/0052195 | A1 | | 12/2001 | Blakey | |
| 2004/0128860 | A1 | | 7/2004 | Smaldone et al. | |
| 2005/0252038 | A1 | | 11/2005 | Braunschweiler | |

OTHER PUBLICATIONS

Office Action issued in European Patent Application, Application No. 05812938.8, issued Jul. 6, 2010 (related to the parent application).

First Office Action issued in Chinese Patent Application, Application No. 2005800463657, issued Dec. 26, 2008 (related to the parent application).

Second Office Action issued in Chinese Patent Application, Application No. 2005800463657, issued Aug. 21, 2009 (related to the parent application).

Third Office Action issued in Chinese Patent Application, Application No. 2005800463657, issued Mar. 2, 2010 (related to the parent application).

Fourth Office Action issued in Chinese Patent Application, Application No. 2005800463657, issued Aug. 6, 2010 (related to the parent application).

* cited by examiner

IMPACT-ATTENUATING ELEMENTS REMOVABLY MOUNTED IN FOOTWEAR OR OTHER PRODUCTS

CROSS-REFERENCE TO RELATED APPLICATION

This Non-Provisional U.S. Patent Application is continuation-in-part application of and claims priority to co-pending U.S. patent application Ser. No. 12/465,546, which was filed in the U.S. Patent and Trademark Office on May 13, 2009 and is entitled, "Impact-Attenuating Elements Removably Mounted in Footwear or Other Products," which is a divisional application of and claims priority to U.S. patent application Ser. No. 10/997,981, which was filed in the U.S. Patent and Trademark Office on Nov. 29, 2004 and entitled "Impact-Attenuating Elements Removably Mounted in Footwear or Other Products." Each of these patent applications is entirely incorporated herein by reference.

FIELD OF THE INVENTION

The invention relates generally to impact-attenuating elements, products containing them, and methods of using them. Such elements may be provided in a wide variety of different products, e.g., in footwear products or other foot-receiving devices, such as in the heel and/or forefoot areas of footwear products.

BACKGROUND

Conventional articles of athletic footwear have included two primary elements, namely, an upper member and a sole member structure. The upper member provides at least a partial covering for the foot that securely receives and positions the foot with respect to the sole structure. In addition, the upper member may have structures and a configuration that protect the foot and provide ventilation, thereby cooling the foot and removing perspiration. The sole structure generally is secured to a lower portion of the upper member and generally is positioned between the foot and the ground. In addition to attenuating ground reaction forces, the sole structure may provide traction and help control foot motions, such as pronation. Accordingly, the upper member and the sole structure operate cooperatively to provide a comfortable structure that is suited for a variety of ambulatory activities, such as walking and running.

The sole member or structure of athletic footwear generally has exhibited a layered configuration that includes a comfort-enhancing insole, a resilient midsole (e.g., formed from a polymer foam material), and a ground-contacting outsole that provides both abrasion-resistance and traction. The midsole typically is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas.

As noted above, various ground reaction force attenuating elements and systems have been known, including such elements and systems for use in footwear products including athletic footwear products. Conventionally, the structure, feel, and characteristics of such elements and systems are selected by a footwear manufacturer, and these elements and systems (as well as their associated characteristics) are permanently fixed in the footwear products once the footwear products are made. Each individual footwear user, however, possesses unique characteristics that affect their physical fitness or training regimes, such as weight, foot size, type of workout or exercise performed, stride or gait characteristics (e.g., a pronation or supination tendency), personal tastes and preferences, etc. Therefore, this "one size fits all" approach to footwear design and production can lead to uncomfortable fits and/or limited sales due to the failure of the footwear products to match the conditions or characteristics desired and/or preferred by users.

Further, manufacturers invest significant amounts of time and money in testing various components of an article of footwear. This testing helps manufacturers to produce the most valuable products that are desired by the widest range of consumers for the products. For example, manufacturers often test various new ideas for products by performing mechanical and reliability testing that provides the manufacturer with valuable information. Additionally, manufacturers may also want to receive feedback from human testers who wear the footwear during certain activities, such as athletic activities (e.g., running, jogging, and other ambulatory activities).

Manufacturers researchers find that the quality of the feedback from human testers varies significantly, which makes the value of such feedback limited. The feedback from human testers is difficult to regulate because many of the human testers are not trained and/or the testers base their feedback on subjective criteria, such as preference for the product, appearance of the product, a pre-conceived expectation of the product, and other subjective criteria. The feedback that the manufacturer or researcher most desires is objective, analytical feedback relating to performance of the product. Many human testers find it difficult to distinguish between objective and subjective feedback. If a manufacturer or researcher is able to obtain objective, analytical feedback of products, such feedback would improve the manufacturer's ability to develop higher quality products and develop products that better match the consumers' needs and wants.

Accordingly, it would be useful to provide footwear products or other foot-receiving devices that are readily customizable to a user's tastes and specifications, e.g., based on the user's individualized needs and/or the characteristics he/she desires in the footwear product or other foot-receiving device in general and/or at a given time. Further, it would be useful to provide methods of testing various components of a footwear product or other foot-receiving device to obtain objective, analytical feedback about a product. Even further, it would be useful to provide methods of training human testers to provide researchers or manufacturers of products with objective, analytical feedback for a product to improve the researchers' or manufacturers' ability to make better products and meet consumers' needs and wants for such products.

SUMMARY

The following presents a general summary of aspects of the invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to impact-attenuating elements and products in which they are used (such as footwear, other foot-receiving devices, and the like). Impact-attenuating elements in accordance with at least some example aspects of this invention may include, for example: (a) a first base member; (b) optionally a second base member; and (c) a plurality of impact-attenuating members. The impact-attenuating members may be engaged with the first and/or second base members to provide an integral structure and/or they may be at least partially provided between the first and second base members. At least one of the first base member, the second base member, and/or the impact-attenuating members may include a means for releasably securing the impact-attenuating element to a foot-receiving device (e.g., to an upper member, a sole member, and/or the like).

Impact-attenuating elements, e.g., of the type described above, may be included in pieces of footwear and/or other foot-receiving devices (e.g., athletic shoes) in accordance with additional aspects of this invention. Such pieces of footwear or foot-receiving devices may include, inter alia: (a) an upper member; (b) a sole member engaged (directly or indirectly) with the upper member (e.g., at least in a toe area); and (c) an impact-attenuating element included as part of the sole member and/or the upper member and/or provided between the upper member and at least a portion of the sole member (e.g., at least in the heel area). In at least some examples, the impact-attenuating element may be attached to or included as a part of at least one of the upper member or the sole member. The impact-attenuating element may include a plurality of impact-attenuating members and a means for releasably securing the impact-attenuating element to at least one of a portion of the upper member or a portion of the sole member.

Additional aspects of this invention relate to methods for including impact-attenuating elements in products, such as in pieces of footwear or other foot-receiving devices. Such methods may include, for example: (a) providing an upper member and a sole member of a foot-receiving device; and (b) releasably engaging an impact-attenuating element with at least one of the upper member or the sole member. The impact-attenuating element may include a plurality of impact-attenuating members and a means for releasably securing the impact-attenuating element to at least one of a portion of the upper member or a portion of the sole member. In at least some examples of the invention, the impact-attenuating element will be releasably engaged at a heel area of the foot-receiving device, although it may be engaged in other areas without departing from the invention.

Even more additional aspects of the invention relate to methods comprising: (a) instructing a first wearer to insert into a sole structure of an article of footwear a first removable insert having a first set of characteristics, the first removable insert being inserted into at least one of a forefoot region, a midfoot region, and a heel region; (b) instructing the first wearer to perform at least one athletic activity while wearing the article of footwear containing the sole structure with the first removable insert; (c) instructing the first wearer to remove the first removable insert from the sole structure; (d) instructing the first wearer to insert into the sole structure a second removable insert having a second set of characteristics that are different from the first set of characteristics, the second removable insert being inserted into the at least one of a forefoot region, a midfoot region, and a heel region of the sole structure; (e) instructing the first wearer to perform the at least one athletic activity while wearing the article of footwear containing the sole structure with the second removable insert; and (f) recording information in a tangible medium of expression relating to or comparing the first set of characteristics and the second set of characteristics.

In yet another aspect of the invention, a method comprises: (a) inserting into a sole structure of an article of footwear a first removable insert having a first set of characteristics, the first removable insert being inserted into at least one of a forefoot region, a midfoot region, and a heel region of the sole structure; (b) performing at least one athletic activity while wearing an article of footwear containing the sole structure with the first removable insert; (c) removing the first removable insert from the sole structure; (d) inserting into the sole structure a second removable insert having a second set of characteristics that are different than the first set of characteristics, wherein the second removable insert is inserted into the at least one of a forefoot region, a midfoot region, and a heel region of the sole structure; (e) performing the at least one athletic activity while wearing the article of footwear containing the sole structure with the second removable insert; and (f) recording information in a tangible medium of expression relating to or comparing the first set of characteristics and the second set of characteristics.

In still another aspect of the invention, a method of training testers of an article of footwear comprises: (a) providing to a first tester an article of footwear having a first removable insert that is inserted into a sole structure of the article of footwear; (b) instructing the first tester to perform at least one athletic activity while wearing the article of footwear with the first removable insert inserted into the sole structure; (c) instructing the first tester to provide a first descriptive analysis of the performance of the first removable insert during the at least one athletic activity; (d) providing to the first tester the article of footwear having a second removable insert that is inserted into the sole structure of the article of footwear; (e) instructing the first tester to perform the at least one athletic activity while wearing the article of footwear with the second removable insert inserted into the sole structure; (f) instructing the first tester to provide a second descriptive analysis of the performance of the second removable insert during the at least one athletic activity; and (g) recording information in a tangible medium of expression relating to or comparing the first descriptive analysis and the second descriptive analysis.

Such methods may be performed by manufacturers, developers, and other entities handling developments of products. Such methods may be used to create custom designed footwear, test footwear, train human testers of footwear, and any other benefit that can be realized from footwear with sole structures having one or more removable inserts.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1A:
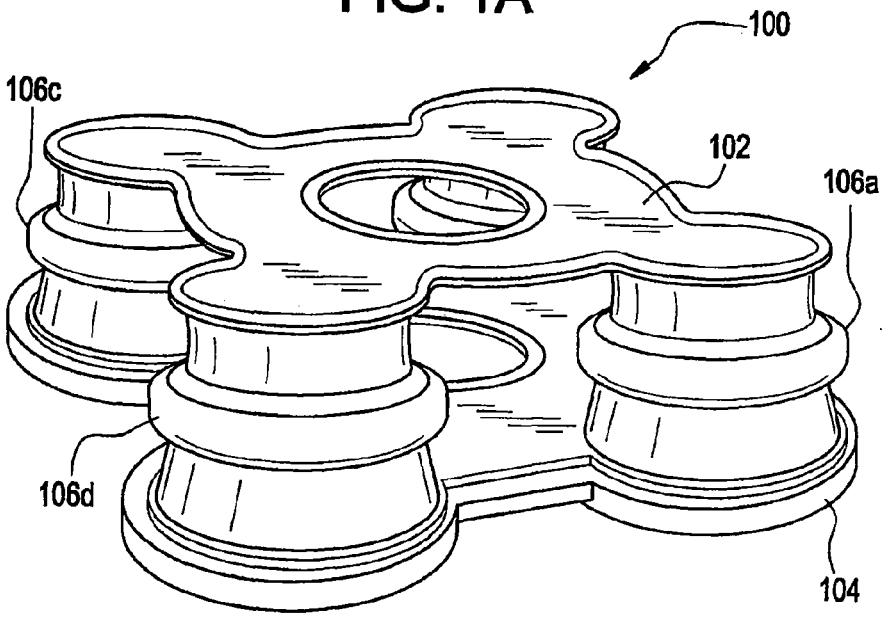
FIGS. 1A and 1B provide perspective views of an example impact-attenuating element in accordance with one example of this invention.

In the following description of various examples of the invention, reference is made to the accompanying drawings, which form a part hereof, and in which are shown by way of illustration various example systems and environments in which the invention may be practiced. It is to be understood that other specific arrangements of parts, example systems, and environments may be utilized, and that structural and functional modifications may be made without departing from the scope of the present invention. Also, while the terms "top," "bottom," "side," "front," "rear," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Impact-Attenuating Elements and Other Example Aspects of the Invention; Specific Examples of the Invention; and Conclusion.

A. TERMS

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like.

B. GENERAL DESCRIPTION OF IMPACT-ATTENUATING ELEMENTS AND OTHER EXAMPLE ASPECTS OF THE INVENTION

In general, aspects of this invention relate to impact-attenuating elements, products in which they are used (such as footwear, other foot-receiving devices, and the like), and methods for using them and/or including them in footwear, foot-receiving devices, and the like. Impact-attenuating elements in accordance with at least some example aspects of this invention may include, for example: (a) a first base member; (b) optionally a second base member; and (c) a plurality of impact-attenuating members. The impact-attenuating members may be engaged with the first and/or second base members to form an integral structure and/or may be provided at least partially between the first and second base members (when two base members are present). At least one of the first base member, the second base member, and/or the impact-attenuating members may include a means for releasably securing the impact-attenuating element to a foot-receiving device. In at least some examples of the invention, both the first base member and the second base member will include means for releasably securing the impact-attenuating element to a portion of a foot-receiving device, and optionally, in at least some instances, these means will act and function separately and independently from one another. Optionally, if desired, the two means for releasably securing, when two are present, also may structurally differ from one another.

The "means for releasably securing" the impact-attenuating element to another portion of the foot-receiving device structure (e.g., to a portion of the sole member, the upper member, etc.) may take on any desired structure without departing from the invention. For example, the "means for releasably securing" may include: one or more threaded fastener arrangements; one or more hook-and-loop fastener arrangements (e.g., a portion adhesively attached to the impact-attenuating element and a portion adhesively attached to the foot-receiving device (e.g., to a portion of the upper member or sole member)); one or more securing strap arrangements (e.g., attachable to the impact-attenuating element and the foot-receiving device (e.g., to a portion of the upper member or sole member) via snaps, buttons, retaining elements, or other connectors); one or more snap fastener arrangements; one or more turnbuckle fastener arrangements; one or more tab/retaining element type fastener arrangements; one or more raised rib/retaining element type fastening arrangements; and the like.

Additional aspects of this invention relate to pieces of footwear or other foot-receiving devices that include impact-attenuating elements (e.g., athletic shoes). More specifically, such pieces of footwear or other foot-receiving devices may include, inter alia: (a) an upper member; (b) a sole member engaged (directly or indirectly) with the upper member; and (c) an impact-attenuating element provided between the upper member and at least a portion of the sole member and/or engaged (directly or indirectly) with at least one of the upper member or the sole member. The impact-attenuating element may include a plurality of impact-attenuating members and a means for releasably securing the impact-attenuating element to at least one of a portion of the upper member or a portion of the sole member. The impact-attenuating element may be of the general types described above.

In at least some examples of the invention, the sole member may be engaged at a toe area of the foot-receiving device and the impact-attenuating element may be engaged at a heel area of the foot-receiving device. Optionally, in some examples, the sole member (e.g., an outsole portion of the sole member) may cover at least a portion of the impact-attenuating element. In still other examples, an exterior surface of the impact-attenuating element may be formed from a suitable material and/or include one or more traction elements so as to function as at least a portion of an outsole for the footwear or other foot-receiving device. As still other examples, impact-attenuating elements of the type described above may be provided in the toe area, and/or in any other desired location in the foot-receiving device without departing from this invention.

In some example foot-receiving device structures according to the invention, an exterior portion of the impact-attenuating element will remain at least partially visible and exposed, even after assembly of the footwear or foot-receiving device is completed and/or while the footwear or foot-receiving device is in use. In other examples, however, if desired, the impact-attenuating element may be enclosed in the foot-receiving device structure without departing from the invention. Optionally, if desired, the foot-receiving device structure may allow access to the impact-attenuating element in such enclosed structures, e.g., for later removal, customization, etc., as described in more detail below.

Still additional aspects of the invention relate to methods for including one or more impact-attenuating elements in a piece of footwear or other foot-receiving device. Such methods may include, for example: (a) providing an upper member and a sole member of a foot-receiving device; and (b) releasably engaging an impact-attenuating element (directly or indirectly) with at least one of the upper member or the sole member. The impact-attenuating element may include a plurality of impact-attenuating members and a means for releasably securing the impact-attenuating element to at least one of the upper member or the sole member. In at least some examples of the invention, the impact-attenuating element will be releasably engaged at a heel area of the foot-receiving device, although it may be engaged in other areas, as described above, without departing from the invention.

The step of releasably engaging the impact-attenuating element with the upper member or the sole member may take place in any desired manner without departing from the invention. For example, it may include: engaging threaded regions provided on the various elements; engaging a hook-and-loop fastener arrangement; engaging a securing strap arrangement; engaging buttons, snaps, or other retaining devices; engaging a turnbuckle fastener arrangement; engaging one or more tabs around a retaining element; engaging a retaining element around a raised rib; inserting a tab member through a recess and retaining it against a retaining element; and the like. The impact-attenuating element may be of the types described above (and described in more detail below).

Additional aspects of the invention relate to the ability for users (or others) to freely and selectively interchange one impact-attenuating element for another, e.g., to customize the foot-receiving device for a specific user's characteristics and/or for specific use characteristics. Thus, in accordance with at least some aspects of the invention, a user may disengage one impact-attenuating element from a foot-receiving device and releasably engage another impact-attenuating element with it. The new impact-attenuating element may be of the same structure and other characteristics as the one removed, or it may have a different structure or other characteristics. As more specific examples, the impact-attenuating element may be selected based on one or more characteristics of the intended end user, such as: the user's weight, the user's shoe size, the user's foot width, the user's moving speed or anticipated moving speed, the user's typical stride or gait (e.g., a pronation or supination tendency, etc.), and the like. Also, different impact-attenuating elements may be selected depending on the final intended end use of the footwear or foot-receiving device products. For example, different impact-attenuating elements may be selected depending on whether the user intends to use the product for walking, running, basketball, soccer, football, baseball, softball, sprinting, track events, field events, cross-training, children's games, video games, etc. A user also may select different impact-attenuating elements based on their particular preferences, such as comfort, feel, etc. Further, if desired, one shoe of a pair may have an impact-attenuating element of different characteristics as compared to the other shoe of the pair.

The impact-attenuating elements also may be selected and/or included as part of the footwear or other foot-receiving device structure at any desired location and/or point in the distribution chain without departing from the invention. For example, the impact-attenuating elements may be selected at the assembly factory and the products then may be marketed in a manner targeted to specific intended users or use characteristics (e.g., the sales box or a tag on the product might indicate that the shoe is designed for running or jogging for a user between 165 and 180 lbs.). As another example, shoe retailers or wholesalers may have a supply of impact-attenuating elements available to insert into the footwear or other foot-receiving device at the point of sale and/or a shipping location, e.g., based on the characteristics of the intended user and/or the intended use, to replenish depleted stock, etc. As still another example, users may be allowed to freely select and/or change impact-attenuating elements based on their immediate needs or the characteristics they desire in the footwear or other foot-receiving device at a given time (e.g., by switching one impact-attenuating element for another at a point of use location, etc.).

In addition to the customization features that foot-receiving devices with removable impact-attenuating elements may offer, such a configuration also may make more efficient and streamline the process of testing these products. Manufacturers or other developers of footwear and other foot-receiving devices often test various features of these products. Manufacturers may want to test any aspect of the footwear. For example, manufacturers may want to test the sole structure because the sole structure provides the impact-attenuating features of the footwear. Manufacturers perform many different tests that measure various aspects of the footwear, including, but not limited to, reliability/durability; objective, analytical analysis; and subjective, opinion-based analysis. Oftentimes, manufacturers will solicit help from human testers to obtain at least some subjective and objective analysis of the footwear product(s). The subjective analysis is relatively easy to obtain from human testers since it is based on personal opinion, expectation of the product, and preferences. However, objective analysis is much more difficult to obtain from human testers because it requires the human testers to analyze the product based on objective measurements of various aspects of the footwear (e.g., resilience, hardness, stability, support, and grip), sensory perception, and scale-based description of the footwear (cf. a subjective description based on personal opinion). To obtain valuable objective analysis of the foot-receiving devices, manufacturers may train the human testers to provide the valuable objective, analytical analysis. Such training strives to make the multiple testers' ability to judge the characteristics of the footwear more uniform.

Methods of testing various aspects of the sole structure of a foot-receiving device or of providing the wearer with the option to customize a foot-receiving device, comprises steps of: (a) instructing a first wearer to insert into a sole structure of an article of footwear a first removable insert having a first set of characteristics, the first removable insert being inserted into at least one of a forefoot region, a midfoot region, and a heel region; (b) instructing the first wearer to perform at least one athletic activity while wearing the article of footwear containing the sole structure with the first removable insert; (c) instructing the first wearer to remove the first removable insert from the sole structure; (d) instructing the first wearer to insert into the sole structure a second removable insert having a second set of characteristics that are different from the first set of characteristics, the second removable insert being inserted into the at least one of a forefoot region, a midfoot region, and a heel region of the sole structure; (e) instructing the first wearer to perform the at least one athletic activity while wearing the article of footwear containing the sole structure with the second removable insert; and (f) recording information in a tangible medium of expression relating to or comparing the first set of characteristics and the second set of characteristics.

In this example, the manufacturer may provide the first wearer with all of the elements to perform the above described method(s) in the form of a kit or at an event hosted by the manufacturer (or any other entity) that is designed for one or more wearers. An event may be hosted at any location including a point of sale (such as a retail location), a testing facility, a sporting event, or any other suitable location. The instructions may be given to one or more wearers by written instructions (e.g., such as written instructions that are included in a kit), electronic instructions (e.g., such as instructions that appear on an interface of a computing device, such as a kiosk, handheld computing device, or other computing device), and/or by verbal instructions given by one or more human representative(s) of the manufacturer or any other entity (e.g., such as a sales representative at a retail location or a sporting event or a trainer at a testing facility). The human representative may be a researcher, a representative from the manufacturer or a third party that is associated with the manufacturer.

The footwear to be tested may include an upper and a sole structure. The sole structure may be attached to the upper and may be positioned between the upper and the ground when the foot-receiving device is worn by a wearer. The sole structure may help provide traction and may attenuate impact forces when the sole member engages with the ground during wear such as during walking, running, and other ambulatory activities that cause the sole structure to engage with a surface. For reference purposes only, the footwear may be divided into three general regions: a forefoot region, a midfoot region, and a heel region. The forefoot region may correspond with the portion of the article of footwear that may be capable of receiving and/or housing the metatarsals and phalanges (the toes and corresponding joint bones). The midfoot region may correspond with the arch area of the foot, and the heel region may correspond with the rear portion of the foot, including the calcaneous bone. The forefoot region, the midfoot region, and the heel region are intended to represent general areas of the footwear to aid in the following discussion and are not intended to demarcate precise areas of the footwear. The forefoot region, the midfoot region, and the heel region also may correspond to the sole member, the upper, and the individual elements thereof.

The footwear may have a sole structure with one or more openings for receiving an insert. In this context, an "insert" is intended to include at least a portion of the sole structure that provides impact-attenuating features (i.e., the "insert" may be any impact-attenuating element). Some example footwear have a single opening in the sole structure. The single opening may be in any region (i.e., the forefoot region, the midfoot region, or the heel region) of the sole structure of the footwear. In one example, the sole structure has a single opening in the heel region for receiving various inserts. In another example, the sole structure has a single opening in the forefoot region for receiving various inserts. In yet other examples, the sole structure has two openings. The first opening may be positioned in the forefoot region and the second opening may be positioned in the heel region of the sole structure. In some examples with two openings, a column or other stabilizing member may be positioned between the two openings to provide the sole structure with some structural support (i.e., to prevent its collapse). In an example with two openings, the insert may comprise the midsole and may be inserted into the openings that are defined between the outsole and the upper. The outsole may be secured to the remainder of the foot-receiving device (i.e., the upper) via any suitable retaining mechanism such as, but not limited to, hook and loop fasteners, elastic and hook fasteners, mechanical interface(s), buckles, buttons, snaps, other mechanical connectors, and the like.

The sole structure may include a midsole and an outsole. The insert described above may comprise at least a portion of the midsole. In some examples, the insert comprises the entire midsole. In other examples, the insert comprises at least a portion of the midsole and at least a portion of the outsole. The insert may comprise any portion of the midsole and/or the outsole.

The insert(s) described above may be inserted into the sole structure of the footwear in any one or more of the forefoot region, the midfoot region, and the heel region of the footwear. In the examples in which multiple inserts are inserted into any one region of the sole structure of the footwear, at least two of the inserts may have different characteristics and/or properties. The wearer(s) may compare the characteristics of a first insert with the characteristics of a second insert (or any number of additional inserts). One or more of the inserts may be a "reference" insert. Such reference inserts may provide a basis for "comparing" one or more other inserts or providing objective, analytical analysis (e.g., "descriptive analysis") about one or more inserts. For example, a first wearer may be provided with a reference insert for inclusion in a sole structure of an article of footwear. The first wearer may be provided with a reference descriptive analysis about the reference insert (e.g., "this insert has been designated as a hard and stiff midsole component"). The first wearer may be able to understand the scale that is used to describe the objective, descriptive analysis of the reference insert by wearing the footwear having the reference insert while simultaneously or thereafter reviewing the reference descriptive analysis. This physical process will provide the wearer with an example of an objective value for at least one characteristic of the reference insert. This process also will provide the wearer with a reference upon which to base descriptive analysis of other inserts.

Wearers may be instructed to record information in a tangible medium of expression relating to or comparing the characteristics of one or more inserts. A tangible medium of expression may include written expression (e.g., paper, forms, etc.), electronic expression (e.g., voice recording(s), electronic text messages, e-mail, interfaces of computing devices, mobile telephones, and any other form of electronic communication), and verbal instructions/requests. The source of the instructions may be the manufacturer of the footwear, a testing entity, a fellow tester or athlete, a researcher, or any other source.

The step of recording information may include instructing the wearer(s) to provide a descriptive analysis of the performance of one or more inserts, instructing the wearer(s) to assign various ratings to one or more inserts based on the corresponding characteristics of the inserts, instructing the wearer(s) to rank one or more inserts, instructing the wearer (s) to assign a value from a predetermined scale to one or more aspects of one or more inserts, and the like. The step of recording information in a tangible medium of expression may include any form of both subjective and objective analysis. The step of recording information may be performed by one or more of the wearer, the manufacturer/developer, and/or any third party.

Descriptive analysis includes any form of objective analysis of an object. In the footwear examples, the descriptive analysis may be provided about one or more inserts for a sole structure of the foot-receiving device. Such descriptive analysis of the inserts may include various types of information about the insert and/or its "feel" in the final product, such as resilience, hardness, stability, support, and grip of the footwear when the insert is inserted into the sole structure. Descriptive analysis may include assigning specific values for a characteristic based on various scales and/or references. For example, a linear scale may define a gradation of values for a particular characteristic (i.e., resilience, hardness, stability, support, grip, and the like) from low to high, weak to intense, soft to hard, zero to 100%, and the like. Based on the values defined by the scale, a value is assigned to any one or more characteristics for an insert. These values may be based on numerical values, intensity values, and the like. These values may also be based on magnitude values. Magnitude values may be values that rate the intensity of a characteristic relative to a reference value.

The descriptive analysis may include the wearers' initial feel impression or "perceived attributes" when the footwear (or any other product) is first manipulated or felt. The initial feel impression may disappear quickly over time (i.e., after the wearer has been wearing the footwear for a period of time). For example, these "perceived attributes" may include characteristics such as hardness of the footwear. Hardness may be the firmness or flexibility of the footwear. Specifically, hardness may relate to the firmness or flexibility of at least a portion of the sole structure.

The descriptive analysis also may include the effect of the footwear on the wearer's overall performance. The effect of the footwear on the wearer's overall performance may include characteristics of the footwear such as resilience, stability, hardness, support, and grip. Specifically, these characteristics may relate to the sole structure of the footwear. The "effect" may include characteristics that are noticeable during the wearer's performance of athletic activities. Sometimes the wearer will perform certain activities (i.e. activities that would normally be performed while wearing the footwear, such as ambulatory activities and other athletic related activities) while wearing the footwear in order to provide descriptive analysis of the footwear. Examples of athletic activities include, but are not limited to, running, jumping, walking, jogging, planting and pivoting, changing direction, and any other activity that is generally associated with moving the wearer's body and/or feet. The term "athletic activities," as used herein, includes any activity, without regard for whether the activity is actually being performed during an athletic movement. Therefore, "athletic activities" includes all movements of a wearer of an article of footwear, as described herein.

"Resilience" of the footwear may be defined as the responsiveness of the footwear after the footwear has experienced certain forces or pressures (e.g., pivoting, planting and turning, jumping, other impact activities, and the like). "Stability" may relate to the wearer's assessment of the security of the wearer's movements while wearing the footwear. For example, stability may relate to whether the footwear permits/prohibits the wearer from making steady, secure contact with the ground while performing one or more activities. "Support" may relate to providing assistance or a base to various portions of the wearer's foot during an activity performed while wearing the footwear. The support may pertain to any portion(s) of the wearer's foot. For example, the support may include the manner in which the sole structure maintains the wearer's foot in a particular position. This may include providing structural support in the form of the sole structure to the forefoot, midfoot, and/or heel region of the wearer's foot so that the wearer's foot bones and muscles are not strained, injured, or otherwise unduly stressed during wear. The grip may pertain to the ability of the sole structure to provide traction between the article of footwear and the surface (i.e., the ground) with which it contacts.

The descriptive analysis also may include characteristics relating to the footwear that are felt by the wearer after the wearer has completed athletic activities. These relate to a "residual" effect of the footwear post-activity. This aspect of the descriptive analysis may relate to any characteristic(s) described above. For example, the "residual" effect of the sole structure may include the muscle/structural fatigue, strain, stress, discomfort, soreness, etc., experienced by the wearer's foot or leg after the athletic activity is complete.

The descriptive analysis and/or any other information recorded in the tangible medium of expression relating to or comparing the characteristics of one or more inserts may be compared, assigned a rating, evaluated, critiqued, or any other use for such information. For example, a wearer may compare characteristics of a first insert to characteristics of a second insert. Such a comparison may occur in any form. The wearer may assign a rating to one or more characteristics for each of the inserts and then, based on the rating, "compare" the ratings of each of the inserts. The rating may be a predetermined scale or any other value that may be assigned to the characteristic(s) of the inserts. The wearers may "assign a rating" as part of recording information relating to the characteristics of the inserts in a tangible medium of expression.

In another example, the wearer may simply "compare" the characteristics of a first insert with the characteristics of a second insert. For example, the wearer might assess that the first insert has a greater hardness in the heel region of the sole structure than the second insert. In this arrangement, there is no requirement for a scale or a value rating. Rather, the comparison is simply based on whether one value for a characteristic of a first insert is greater than, equal to, or less than another value of the same characteristic for a second insert.

In any form of evaluating characteristics of the inserts, one or more "reference" inserts may be provided to the wearer. The reference inserts or simply a "reference" may be evaluated by one or more wearers/testers that are "skilled" at providing an objective analysis of the insert. These wearers/testers may assign a value to various characteristics of the insert. These wearers/testers may have been trained or otherwise educated regarding the value(s) that should be assigned to the various characteristics of the insert(s). The wearers/ testers may be associated with the manufacturers or developers of the product. They may help to define or establish the scale or values for evaluating the footwear. The wearers/testers can use any suitable objective information to help develop the scale or values on which to evaluate the characteristics of the inserts. The reference inserts may be accompanied by a reference descriptive analysis that is created by the wearers/testers. This combination of reference insert and corresponding reference descriptive analysis may be provided to the wearer(s)/tester(s) of the test insert(s) (i.e., the inserts that are being evaluated or are not included in the "reference" insert(s)). The reference insert and reference descriptive analysis may be used to train, educate, provide examples, or otherwise illustrate the objective rating upon which the other inserts should be evaluated. Ratings for the reference inserts also may be assigned, at least in part, based on various objective characteristics, such as foam hardness, foam rebound time, foam density, etc.

In an example, the reference descriptive analysis may provide a value for the following three characteristics of a sole structure of an article of footwear: hardness of the sole structure; stability of the sole structure; and grip of the sole structure. The wearers may receive instruction from a source. The source may be any suitable source for providing instructions such as, but not limited to, written instructions, verbal instructions, video instructions, electronic instructions, and/or any other suitable form of instructions. The instructions may include an instruction to "test" the reference insert by inserting the reference insert into the sole structure of the article of footwear. The wearer may then be instructed to perform one or more athletic activities while wearing the footwear having the sole structure with the reference insert. The wearer may be asked to review the reference descriptive analysis for the reference insert before, during, and/or after the wearer performs the one or more athletic activities while wearing the article of footwear containing the sole structure with the reference insert.

Through sensory education, the wearers can learn the objective values/scales upon which to evaluate characteristics of various inserts. The term "sensory education," as used herein, includes learning an objective set of values or scales for evaluating products based on physical attributes experienced and/or observed during physical testing of products. In this specific example, the wearer learns the values/scales used to objectively analyze the reference insert by "sensory education" and can base descriptive analysis (or any other comparing, rating, evaluating, etc.) for another insert on the "sensory education" learned through the descriptive analysis provided and physically experienced for the reference insert. The sensory education may permit the manufacturers/developers of the product to "standardize" analysis and/or evaluations of the products. The term "standardize," as used herein, means to regulate the analysis of a single product by multiple wearers and/or of the analysis of various products by the same wearer such that it is based on the same valuation method (or scale). Standardized analysis provides the manufacturers/developers with the most valuable form of analysis because it reduces (or even removes) the element of subjectivity and opinion (conscious or unconscious) that may influence an otherwise objective analysis. Once the wearers understand the valuation method can provide the manufacturer/developer with useful analysis of a product, the "trained" wearer's/tester's analysis (i.e., descriptive analysis) can be relied upon for further product development and refinement. This type of feedback is very valuable to manufacturers/developers of products.

The footwear with removable inserts may have additional uses such as providing custom designed articles of footwear. A wearer may be able to customize characteristics for the sole structure of the article of footwear by "trying" or "testing" one or more inserts and determining which insert the wearer likes the best. The wearer may compare the characteristics of the inserts being tested with one another. In this custom-design process, the wearer inserts one or more inserts having different characteristics into the sole structure of an article of footwear. The wearer will perform one or more athletic activities with the article of footwear containing the sole structure with the inserts inserted therein. The wearer will record information in a tangible medium relating to or comparing characteristics of a first insert with characteristics of a second insert. Any number of inserts may be tested and/or compared.

Based on the information that the wearer records relating to or comparing the one or more inserts, the wearer is permitted to select for inclusion in the article of footwear the insert(s) that the wearer prefers. This process may be for custom designing the article of footwear. In another example, the wearer may be given (or may purchase) a "kit" that includes an article of footwear with a sole structure and at least two removable inserts that are capable of being inserted into the sole structure. The user may interchange the removable inserts in this example to customize the article of footwear.

Once the wearer has tested or otherwise "tried out" various inserts, the wearer may be provided with an option to custom design an article of footwear that includes at least one of the inserts. For example, if the wearer thought that the first insert had the best qualities, then the wearer may be able to submit a request to manufacture a custom-designed article of footwear containing a sole structure having the characteristics of the first insert. The request may be sent to or received by the manufacturer, a developer, or any other entity that manufactures footwear. The custom-designed footwear may include a sole structure having the characteristics selected by the wearer. The sole structure may be removable or may be permanently attached or integrally formed with any portion of the article of footwear. The wearer also may be able to assign a rating to one or more of the inserts. The wearer may select one or more of the inserts for inclusion in the custom-designed article of footwear based at least in part on the rating assigned to the inserts.

The removable inserts may comprise any suitable material including, but not limited to, compressible foam, rubber, polymers, and the like. For example, the removable inserts may include a resiliently compressible polymer foam material(s) such as ethylvinylacetate or polyurethane. Some removable inserts may have a first portion and a second portion. The first portion may have properties that differ from the second portion. For example, the first portion may be harder than the second portion. In some example constructions, the first portion comprises approximately 50% of the removable insert. The first portion may comprise any percentage of the removable insert. The first portion may be positioned in any suitable position with respect to the second portion. For example, the first portion may entirely surround the second portion. In another example, the first portion may be tapered from the lateral side of the removable insert toward a center region of the removable insert and the second portion may be tapered from the medial side of the removable insert toward the center region of the removable insert. The first portion and the second portion may overlap each other within the center region in this example configuration. The first portion and the second portion may be configured as a "wedge" such that the thinnest portion of the "wedge" of the first portion overlaps with the thinnest portion of the "wedge" of the second portion within the center region of the removable insert. The first portion and the second portion may have any suitable configuration. The removable inserts may have any number of desired "portions" having different properties.

The removable inserts that have two or more portions with different properties provide targeted and/or customized impact-attenuating properties to the wearer. For example, during a normal walking/running cycle the lateral edge of the heel region of the wearer's foot will strike the ground first. The walk/run cycle progresses through the lateral side of the midfoot region and into medial side of the forefoot region. Oftentimes, the last portion of the wearer's foot to leave the ground is the metatarsophalangeal joint of the first phalange/tarsal (the "big" toe). Sometimes, the wearer will plant the distal end of the first phalange into the ground (or other surface) at the end of a walk/run cycle. While this aforementioned walk/run cycle is typical, some wearers may deviate from this typical gait.

During the walk/run cycle, wearers may want a harder and/or a more supportive sole structure in the lateral edge of the heel region as it initially strikes the ground. However, as the wearer progresses through the walk/run cycle, the desired amount of hardness and/or support for the sole structure may decrease. For example, the wearer may wish to have a "medium" amount of hardness and/or support in the midfoot region of the sole structure that contacts the ground approximately in the middle of the walk/run cycle. A "medium" amount may be measured relative to the hardness and/or support desired for the sole structure in the lateral edge of the heel region (the portion that strikes the ground upon impact). The wearer may wish to have a sole structure that includes softer impact-attenuation properties in the medial side of the forefoot region, which comes into contact with the ground at the end of the walk/run cycle. The wedge configuration described above can provide this type of support for the sole structure. For example, the first portion is a relatively hard material and the second portion is a relatively soft material. The lateral area in the heel region is substantially comprised of the relatively hard material and is tapered as it extends toward a center region of the insert. The medial area in the heel region is substantially comprised of the relatively soft material and is tapered as it extends toward the center region. In the center region the first portion overlaps beneath the second portion.

In another aspect of the invention, a method of training testers of an article of footwear comprises: (a) providing to a first tester an article of footwear having a first removable insert that is inserted into a sole structure of the article of footwear; (b) instructing the first tester to perform at least one athletic activity while wearing the article of footwear with the first removable insert inserted into the sole structure; (c) instructing the first tester to provide a first descriptive analysis of the performance of the first removable insert during the at least one athletic activity; (d) providing to the first tester the article of footwear having a second removable insert that is inserted into the sole structure of the article of footwear; (e) instructing the first tester to perform the at least one athletic activity while wearing the article of footwear with the second removable insert inserted into the sole structure; (f) instructing the first tester to provide a second descriptive analysis of the performance of the second removable insert during the at least one athletic activity; and (g) recording information in a tangible medium of expression relating to or comparing the first descriptive analysis with the second descriptive analysis.

The step of recording information may include comparing the first descriptive analysis with a first standardized descriptive analysis and comparing the second descriptive analysis with a second standardized descriptive analysis. In one example, the comparison is performed in a method similar to the method described above relating to the comparison of a descriptive analysis with a corresponding standardized descriptive analysis. The standardized descriptive analysis, as used in this context, means a descriptive analysis that has been provided by a wearer or a group of wearers that has been highly educated in the objective analysis of the footwear. The standardized descriptive analysis is the reference upon which the testers base their analysis for inserts. The standardized descriptive analysis establishes the valuation method for determining objective values for various characteristics of the inserts, as described above.

In some examples of the methods for training testers, a rating may be assigned to the testers based at least in part on the comparison of the first descriptive analysis (provided by the tester) with the first standardized descriptive analysis and a comparison of the second descriptive analysis (provided by the tester) with the second standardized descriptive analysis. This method would "rate" whether the descriptive analysis provided by the tester was similar to the standardized descriptive analysis. If this comparison illustrates that the tester's descriptive analysis is significantly different from the standardized descriptive analysis, then the tester's analysis may not be useful, may be excluded from the results, or the like. Also, such a comparison may indicate that the tester needs additional education or guidance on providing the desired objective analysis of the footwear products. If the comparison of the tester's descriptive analysis with the standardized descriptive analysis is within an acceptable margin of error, then the tester's analysis may be very useful and/or may be included in the results of the testing of the footwear product. Further, if the tester's comparison is within an acceptable margin of error, then the tester may be selected for inclusion in a product test group.

Based on the comparison of the tester's descriptive analysis with a standardized descriptive analysis for one or more inserts, the tester may be assigned a rating. The rating may indicate whether the tester has the requisite skill to participate in a product test group for footwear products. The rating also may indicate strengths and weaknesses of the tester's objective analytical skills of the footwear products. The rating may indicate factors such as whether the tester may require additional education or guidance prior to participating in a product test group. By assigning a rating to each tester in a group of testers, the best testers may be selected for inclusion in a product test group of footwear products. A tester may be selected for inclusion in the product test group based at least in part on the rating assigned to the tester.

A product test group may be a plurality of testers that are compiled to provide manufacturers/developers of footwear products with objective analysis of footwear products. Such analysis by the product test group may be used by the manufacturers/developers to refine products' core features and detailed features. The analysis is also used to track product development. For example, various "generations" of products may be created and manufacturers/developers can compare the analysis of each generation to one another to identify the most beneficial qualities from each generation. This information may be used to improve the product in future generations. The objective feedback can provide the manufacturers/developers with valuable information relating to consumers' evolving needs for the product(s).

Any products may be tested and/or customized in one or more of the manners described above. Also, testers of any product(s) may be trained to provide descriptive analysis of any type of product. For example, any foot-receiving device may be customized or tested or trainers of such foot-receiving devices may be trained in the manner(s) described above.

Specific examples of the invention are described in more detail below. The reader should understand that these specific examples are set forth merely to illustrate examples of the invention, and they should not be construed as limiting the invention.

C. SPECIFIC EXAMPLES OF THE INVENTION

The various figures in this application illustrate examples of impact-attenuating elements useful in systems and methods according to examples of this invention. When the same reference number appears in more than one drawing, that reference number is used consistently in this specification and the drawings to refer to the same part throughout.

Figure 1B:
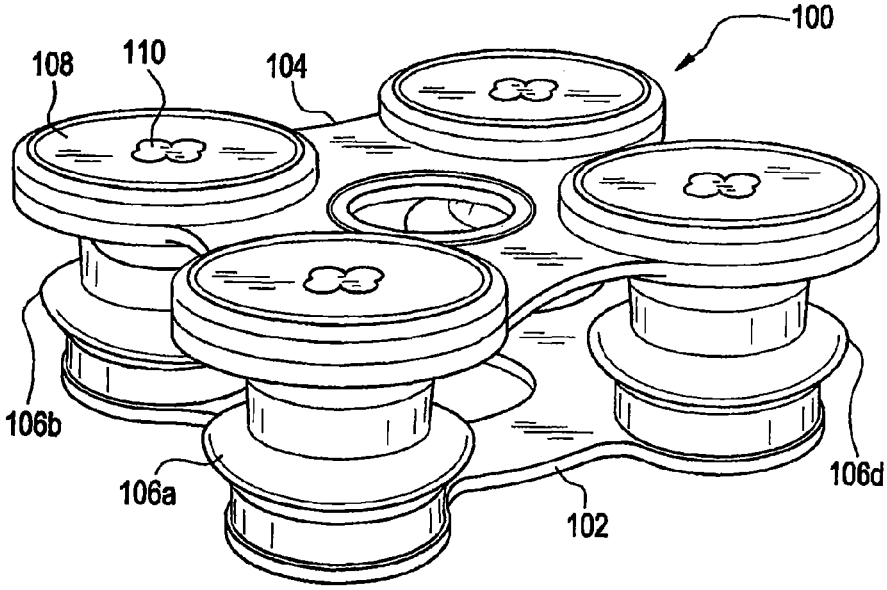

FIGS. 1A and 1B illustrate perspective views of a first example impact-attenuating element 100 in accordance with this invention. As illustrated, this example impact-attenuating element 100 includes a first base member 102 located at the top of the element 100 when placed in a foot-receiving device and a second base member 104 located at the bottom of the element 100 when placed in a foot-receiving device. Plural impact-attenuating members 106*a* through 106*d* are arranged between the first base member 102 and the second base member 104. The plural impact-attenuating members 106*a* through 106*d* may be held together with the base members 102 and 104 in any desired manner to form an integral construction without departing from the invention, such as via adhesives, friction fit, mechanical connectors (e.g., clips, snaps, other retaining elements, etc.), optionally releasable mechanical connectors, integrally formed by molding, etc., and/or the like. In at least some examples of the invention, the impact-attenuating element 100 will form an integral construction for placement in the heel area of a piece of footwear or other foot-receiving device (e.g., also called an "impact-attenuating puck" or a "heel cage" member).

Any desired impact-attenuating members 106*a* through 106*d* may be used without departing from the invention. In at least some examples, the impact-attenuating members 106*a* through 106*d* may include springs, mechanical impact-attenuating devices, and the like. In some examples, the impact-attenuating members 106*a* through 106*d* may be of the type used in SHOX® footwear products commercially available from NIKE, Inc., of Beaverton, Oreg. Also, any desired materials may be used for the base members 102 and 104 without departing from the invention, such as metals, polymeric materials, and the like, including conventional materials known and used in the art.

If desired, in at least some example structures in accordance with the invention, at least an exterior surface 108 or exterior layer(s) of the bottom base member 104 and/or the impact-attenuating members 106*a* through 106*d* may be made of suitable materials and/or may be formed to include tread elements 110 and/or other structures that allow the exterior surface 108 to function as at least a portion of an outsole member for the piece of footwear or other foot-receiving device in which it is mounted. The exterior surface 108 and/or tread elements 110 may be made from any desired material(s) and/or in any desired shape(s) or construction(s) without departing from the invention, including from conventional materials and/or with conventionally shaped tread elements and/or constructions as are known in the art. In at least some examples of the invention, the exterior surface 108 and the tread elements 110 may be made from materials and formed in a manner the same as or similar to those used in known SHOX® footwear products commercially available from NIKE, Inc., of Beaverton, Oreg.

Impact-attenuating elements 100 of the type illustrated in FIGS. 1A and 1B may be releasably or removably mounted in a foot-receiving device, such as in a piece of athletic footwear. The elements 100 may be formed as a secure, cohesive assemblage of parts such that the upper base member 102 and/or the lower base member 104 provide suitable bases for securing the impact-attenuating element 100 to foot-receiving device. Moreover, the base members 102 and/or 104 provided as part of the impact-attenuating element 100 may eliminate the need for plate material as part of the foot-receiving device structure (e.g., eliminate the need for heel plates in the upper member and/or the sole member of the foot-receiving device structure). The integral, one piece assembly of the impact-attenuating elements 100 according to this example of the invention makes assembly of the foot-receiving device easier, as the entire element 100 may be inserted into the foot-receiving device structure as a single piece, eliminating the difficulty in assembling and aligning several relatively small pieces during manufacturing.

Figure 2:
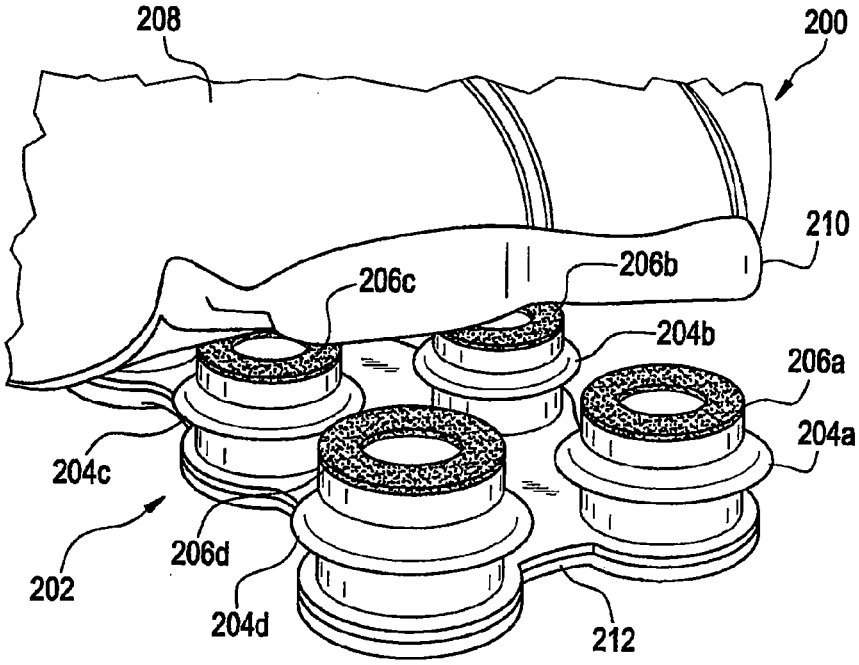
FIGS. 2 through 8 illustrate various examples of structures used for releasably securing an impact-attenuating element to a foot-receiving device.

Various ways of releasably and/or removably attaching one or more impact-attenuating elements, e.g., elements 100, to a foot-receiving device may be used in accordance with examples of this invention. FIG. 2 illustrates a portion of one example foot-receiving device structure 200 in the form of an athletic shoe wherein an impact-attenuating element 202 is provided in the heel area of the shoe 200. In the example structure shown in FIG. 2, the top of each impact-attenuating member 204*a* through 204*d* includes a portion of a hook-and-loop type fastener element 206*a* through 206*d*. These portions of the hook-and-loop fastener elements 206*a* through 206*d* releasably engage corresponding hook-and-loop fastener elements provided on the midsole 210 (or on the insole or the upper members 208) of the foot-receiving device structure 200. If desired, additional securing means may be provided to help further secure the impact-attenuating element 202 to the remainder of the foot-receiving device structure 200. Examples of potential additional securing means will be described in more detail below.

As illustrated in FIG. 2, it is not necessary for impact-attenuating elements in accordance with all examples of the invention to include a top base member and/or a bottom base member like those illustrated in FIGS. 1A and 1B. For example, as shown in FIG. 2, a bottom base member 212 is provided (e.g., made of a material suitable for use as an outsole and/or including traction elements in this example), but the top ends of the impact-attenuating members 204*a* through 204*d* remain free and are not connected to one another through a base member. Of course, if desired, an additional top base member and/or a separate outsole member may be provided without departing from the invention. As another example, if desired, one or more centrally located webs or base members may be provided between the top and bottom of the impact-attenuating members 204*a* through 204*d* to hold the overall impact-attenuating element 202 together as an integral structure. As still another example, if desired, a central impact-attenuating member may be provided between the four illustrated impact-attenuating members 204*a* through 204*d*, wherein a top, bottom, or side surface of the central impact-attenuating member engages and connects with corresponding top, bottom, or side surface of the remaining impact-attenuating members 204*a* through 204*d* to thereby hold the overall impact-attenuating element 202 together as an integral structure. Other ways of holding the overall impact-attenuating element 202 structure together may be used without departing from the invention.

Figure 3:
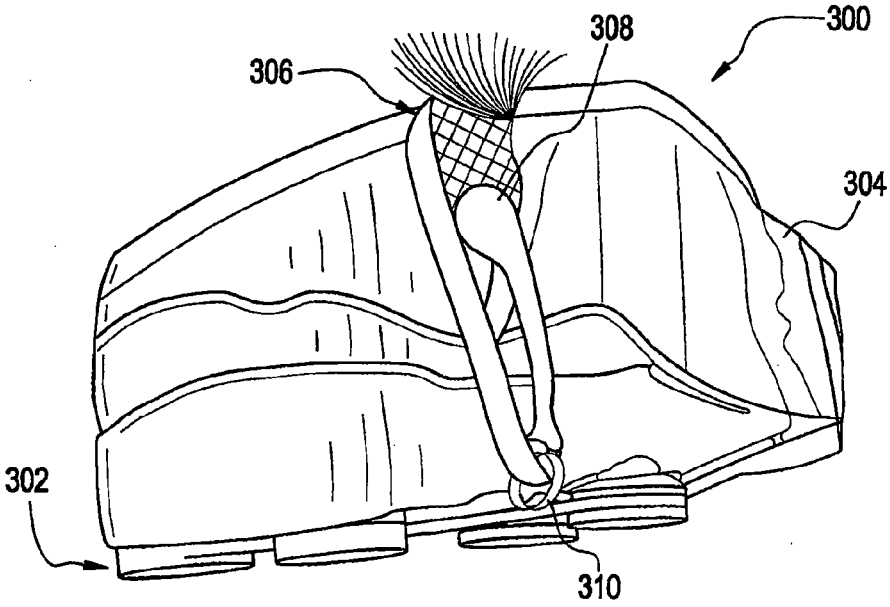

FIG. 3 illustrates another example of a mechanical connecting system that may be used, at least in part, to secure an impact-attenuating element 302 to the remainder of a piece of footwear or other foot-receiving device 300. In this example foot-receiving device structure 300, the impact-attenuating element 302 is fixed to the upper member 304 (or, if desired, to a portion of the sole structure, such as the midsole or insole) via a securing strap element 306. More specifically, in this illustrated example, one end of the securing strap element 306 attaches to or through a connection point 310, e.g., provided as part of the impact-attenuating element structure 302, and a second end of the securing strap element 306 engages (e.g., hooks around, passes through, etc.) a connection point 308 provided on the upper member 304 or on another part of the overall foot-receiving device structure 300 (e.g., optionally, if desired, connection point 308 may be provided on a portion of the sole structure (e.g., the midsole, etc.)).

Optionally, if desired, more than one securing strap arrangement may be present in the overall structure 300 without departing from the invention (e.g., one or more on each side of the device 300, one or more at the back of the heel, etc.). As another alternative or option, a single securing strap 306 may be provided that extends from a connection point 308 on one side of the foot-receiving device structure 300 (e.g., from the upper member or sole member), around the bottom of the impact-attenuating element 302, and around to a connection point 308 on the opposite side of the foot-receiving device structure 300 (e.g., to the upper member or sole member). Optionally, if desired, such a securing strap 306 also may be secured to a member provided on the impact-attenuating element 302 structure, such as through one or more openings or retaining elements provided as part of the impact-attenuating element 302. Additionally or alternatively, if desired, the securing strap 306 may extend through a recess or groove formed in the bottom of the impact-attenuating element structure 302 and/or in the bottom of the outsole member (if any) so that the securing strap 306 or parts thereof do not directly contact the ground surface in use. As still another alternative, the securing strap 306 may fit through or engage a ring or loop or other attachment element or opening provided in the impact-attenuating element 302, the outsole member, and/or other portion of the foot-receiving device structure 300.

FIG. 3 illustrates an additional example feature according to at least some examples of the invention. Particularly, as shown, the entire impact-attenuating element 302 (e.g., each impact-attenuating member or column) need not be exposed in the final foot-receiving device structure 300. Rather, if desired, the impact-attenuating element 302 may fit within a recess provided in the sole structure 310 such that at least the side and top surfaces of the impact-attenuating element 302 are hidden from view in the final assembly and in use. As another alternative, the impact-attenuating element itself may include side surfaces that hide the impact-attenuating members and/or columns in use. Also, if desired, a portion of the outsole may cover the impact-attenuating member in at least some examples of the invention.

Figure 4:
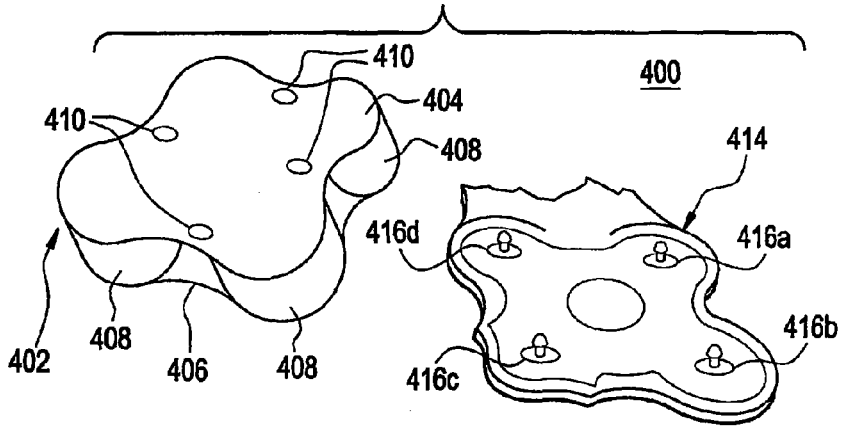

In at least some example structures according to this invention, the impact-attenuating element will include bottom base surfaces (or at least portions thereof) that are not designed to directly engage the ground in use. FIG. 4 illustrates an example of the heel portion 400 of a foot-receiving device structure of this type. Specifically, the impact-attenuating element 402 of this example structure includes a top surface 404, a bottom surface 406, and plural impact-attenuating members 408 located between the top and bottom surfaces 404 and 406, respectively. The top surface 404 includes plural female "snap" type fastener elements 410 that removably and releasably engage with male "snap" type fastener elements (e.g., of the type shown at reference number 416*a* through 416*d*) provided on the remaining structure of the foot-receiving device (while the remaining structure is not shown in FIG. 4, such male "snap" type fastener elements may be provided on the upper member, on a portion of the sole structure (e.g., the midsole or insole), or the like).

In this example arrangement 400, the impact-attenuating element 402 further may be secured to the remainder of the foot-receiving device structure by an outsole flap 414 that includes male "snap" type fastener elements 416*a* through 416*d* that releasably and removably engage female "snap" type fastener elements provided on the exterior surface of the bottom base member 406 (these female snap elements are not shown in FIG. 4). The outsole flap 414 may be integrally formed as part of the overall outsole structure of the piece of footwear or other foot-receiving device, it may be attached to the piece of footwear or other foot-receiving device (e.g., via adhesive, molding, mechanical connections, stitching, one or more shafts, etc.) or the like. In this illustrated example, the exterior surface of the bottom base member 406 is not designed to contact the ground in use (and does not include traction elements or the like), but rather the exterior surface of the outsole flap 414 (not shown in FIG. 4), is made from a material and/or includes traction elements so as to be designed to directly contact and engage the ground (or other surface) in use.

Figure 5:
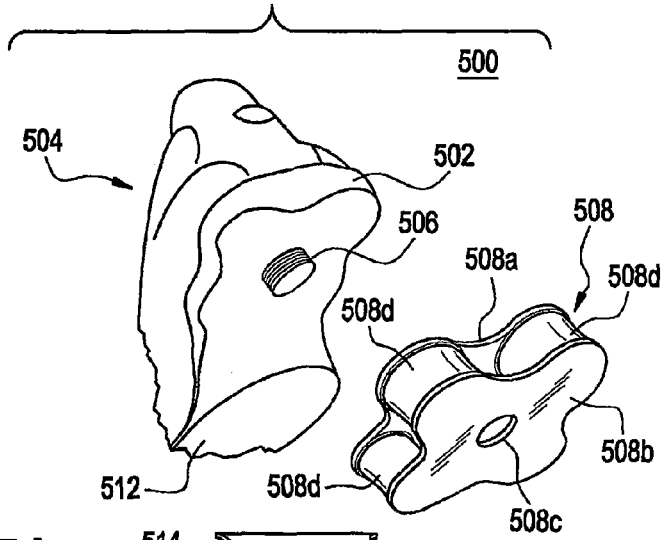

FIG. 5 illustrates an exploded view of an example footwear structure 500 according to this invention. In this example structure 500, a midsole or insole 502 (or other portion) of a piece of footwear 504 includes a mounting member 506 (e.g., a threaded mounting member akin to a bolt in this example). The impact-attenuating element 508 engages the mounting member 506, e.g., by fitting over it and around it. Optionally, in at least some examples, the top base member 508*a* of the impact-attenuating element 508 may include a region (e.g., a threaded region akin to a nut) that releasably and removably engages the threads of the mounting member 506. As another example, the top base member 508*a* simply may include an opening defined therein and the bottom base member 508*b* also may include an opening 508*c* defined therein, and the mounting member 506 may extend at least partially through one or more of these openings, optionally to engage a retaining member (e.g., a separate retaining member have a threaded region akin to a nut, a threaded member integrally provided with the outsole, etc.). As still another example, a threaded member that engages the mounting member 506 may be provided as part of the bottom base member 508*b*.

FIG. 5 further illustrates an outsole flap member 510 that may be included as an integral structure with and/or attached to the outsole 512 of the remainder of the footwear structure. More specifically, the extending flap 514 of the flap member 510 in this example structure may be integrally formed with, may extend from, and/or otherwise may be attached to the foot-retaining device, e.g., at or near the footwear outsole 512. The impact-attenuating member 508 then may be sandwiched between the midsole structure 502 and the outsole flap 510 and removably secured between these structures 502 and 510, e.g., via threaded engagement between the mounting member 506 and a retaining element (e.g., a nut/washer combination or similar type assembly provided on outsole flap member 510). Rather than a threaded engagement, a turnbuckle type arrangement and/or other securing means may be used without departing from the invention. A turnbuckle arrangement will be described in more detail below in connection with FIGS. 9A through 9C.

Figure 5A:
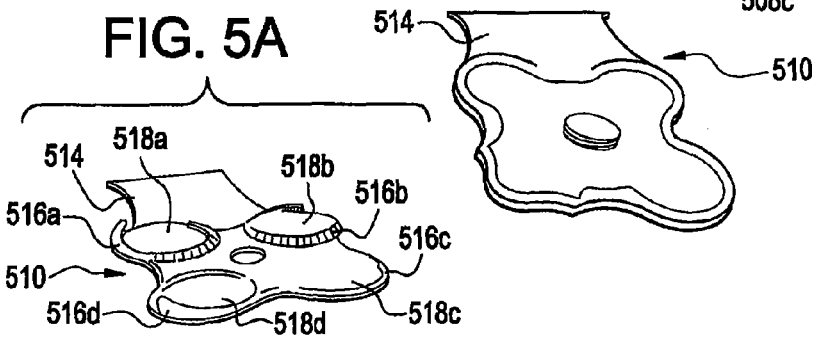

In this illustrated example, the outsole flap 510 completely covers the bottom surface 508*b* of the impact-attenuating element 508, and the exterior surface of the outsole flap 510 functions as a portion of the outsole of the piece of footwear 500. If desired, as illustrated in FIG. 5A, the outsole flap 510 may include raised outer lips 516*a* through 516*d* that define pockets 518*a* through 518*d* into which the various columns 508*d* (or surfaces in base member 508*b* corresponding to columns 508*d*) of the impact-attenuating element 508 may fit, to further help secure the impact-attenuating element 508 to the remainder of the foot-receiving device structure (e.g., for use if the bottom surface of base member 508*b* includes outlines of the columns 508*d* or if no base member 508*b* is included in the impact-attenuating element structure 508). Additionally or alternatively, the raised outer lips 516*a* through 516*d* along the outer edge of the outsole flap 510 may engage around, hold, and help retain the outer edge of the bottom base member 508*b* of the impact-attenuating element 508.

Figure 6:
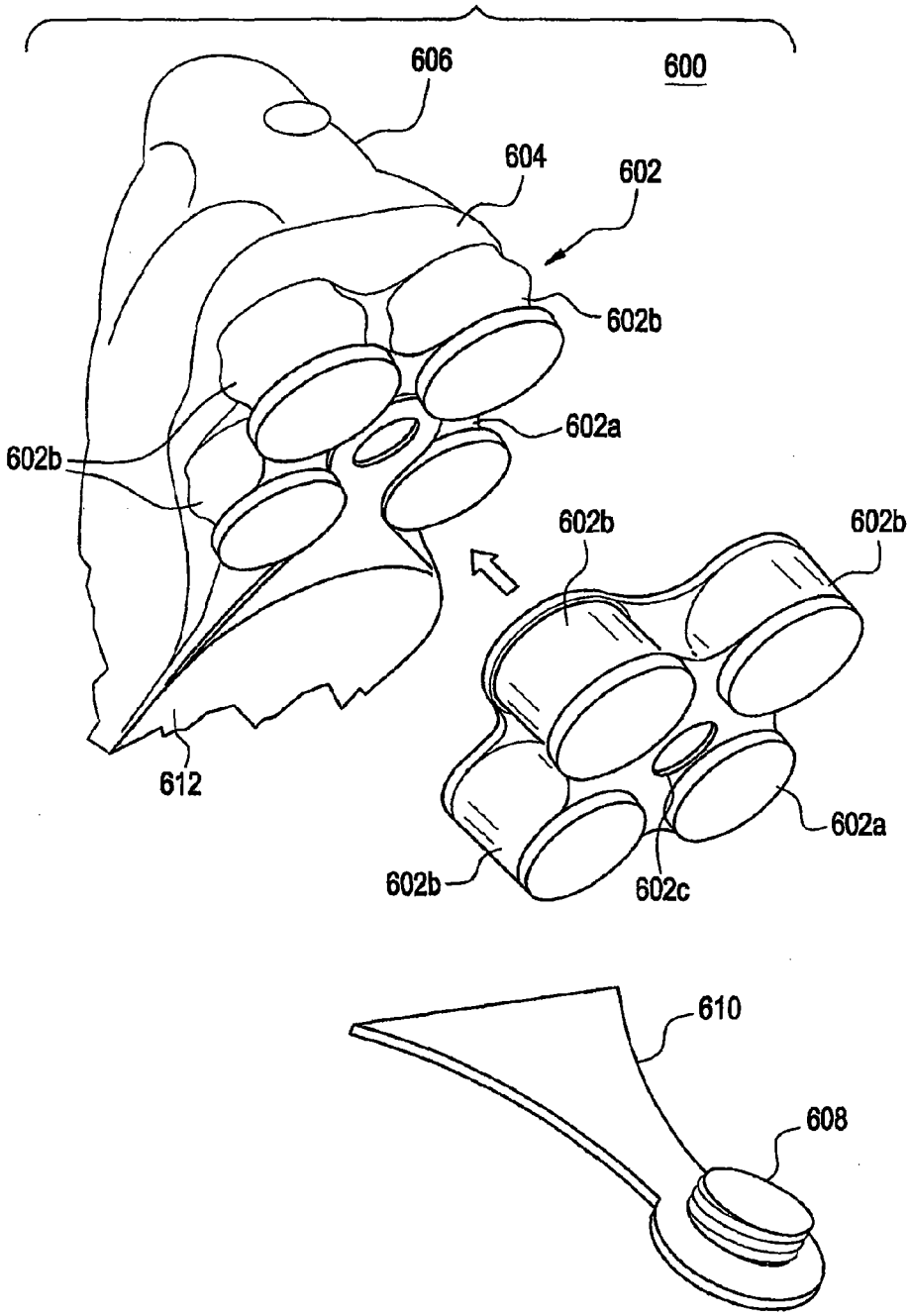

While one or more threaded engagements are described in conjunction with the structure of FIG. 5 (e.g., between a mounting member 506 and an outsole flap 510 (e.g., via a retaining element), between a mounting member 506 and the impact-attenuating element 508, between the impact-attenuating element 508 and the outsole flap 510, etc.), other ways of releasably and removably securing an impact-attenuating element to the remainder of a foot-receiving device structure may be used without departing from the invention. FIG. 6 illustrates another example of securing an impact-attenuating element 602 to the remainder of a foot-receiving device 600 structure. More specifically, in this example, like in the example illustrated in FIG. 5, the impact-attenuating element 602 is sandwiched between a midsole or insole 604 of the piece of footwear 600 (or optionally some portion of the upper member 606) and a retaining element 608 attached to and/or provided as part of an outsole flap 610. The outsole flap 610 may be integrally formed as part of the outsole 612 and/or may be attached to the outsole 612 (or other portion of the foot-receiving device structure 600), e.g., by adhesives, mechanical connections, molding, stitching, rotatable connections, etc. In this example structure, however, the bottom plate 602*a* of the impact-attenuating element 602 (or the bottoms of impact-attenuating members 602*b*) may be formed of a material and/or include traction elements so as to function as a portion of the outsole for the foot-receiving device structure 600. As illustrated in FIG. 6, the flap 610 is sized and shaped so as to fit between two adjacent impact-attenuating members 602*b* provided as part of the impact-attenuating element 602. In this manner, the outsole flap 610 and/or retaining element 608 will not directly contact the ground in use. Alternatively, if desired, a separate outsole plate (e.g., including traction elements) may be sandwiched between the impact-attenuating element 602 bottom surface 602*a* and the outsole flap 610.

Again, any manner of releasably engaging the impact-attenuating member 602 with the remainder of the foot-receiving device structure 600 and/or the outsole flap 610 may be used without departing from the invention. For example, a rotatable threaded retaining member 608 included as part of the flap 610 may engage a corresponding threaded member provided with the impact-attenuating member 602, and a threaded region on the impact-attenuating member 602 may engage a corresponding threaded member on the upper member 606, the midsole member 604, or the like. As another example, a threaded retaining member 608 included as part of the flap 610 may pass through opening 602*c* defined in the impact-attenuating member 602 and engage a corresponding threaded member on the upper member 606, the midsole member 604, or the like. Engaging systems other than threaded regions also may be used without departing from the invention, such as turnbuckles, hook-and-loop fasteners, snap fasteners, securing straps, and the like. Additionally, if desired, the system used for attaching the impact-attenuating element 602 to the upper member 606 or the midsole member 604 (or other structure, if any) may differ structurally and functionally from the system used for attaching the outsole flap 610 to the impact-attenuating member 602 without departing from the invention.

Figure 7:
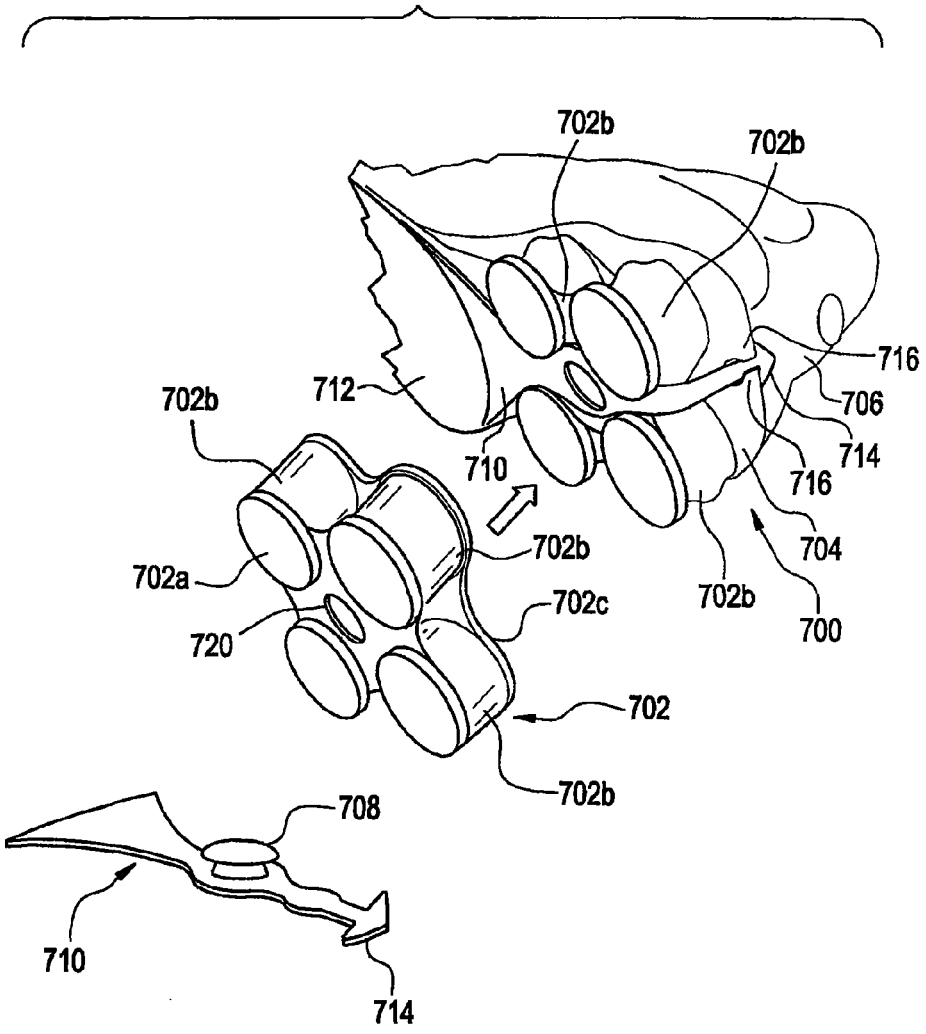

FIG. 7 illustrates a system similar to that shown in FIG. 6, but with a somewhat different type of outsole flap and retaining member. In this example foot-receiving device structure 700, an impact-attenuating element 702 is sandwiched between a midsole 704 of the piece of footwear 700 (or optionally some portion of the insole or upper member 706) and a retaining element 708 provided on an outsole flap 710. The outsole flap 710 may be integrally formed as part of the outsole 712 and/or may be attached to the outsole 712 (and/or to some other portion of the foot-receiving device structure 700), such as by adhesives, molding, mechanical connections, or the like. Like the example structure shown in FIG. 6, in this example structure 700, the bottom plate 702*a* of the impact-attenuating element 702 is formed of a material and/or includes traction elements so as to function as a portion of the outsole for the overall foot-receiving device structure 700. Also, as illustrated in FIG. 7, the flap 710 is sized and shaped so as to fit between the impact-attenuating members 702*b* provided as part of the impact-attenuating element 702. In this manner, the outsole flap 710 and/or retaining element 708 will not directly contact the ground in use. Alternatively, if desired, a separate outsole plate (e.g., including traction elements) may be sandwiched between the impact-attenuating element 702 and the outsole flap 710, and/or the outsole flap 710 may include traction elements and/or other structures for engaging the ground surface.

Again, any manner of releasably engaging the impact-attenuating member 702 with the remainder of the foot-receiving device structure 700 and/or the outsole flap 710 may be used without departing from the invention. For example, as illustrated in FIG. 7, a retaining plug member 708 on the flap 710 may engage a corresponding opening 720 defined in the bottom base member 702*a* of the impact-attenuating member 702, and the opening 720 may be sized and shaped so as to releasably retain the plug member 708 therein (e.g., by retaining the expanded head on plug 708 behind opening 720). If desired, a similar plug member may be provided on the midsole, insole, or upper member to engage a similar opening in the top base member 702*c*, if desired. Alternatively, a similar plug member may be provided on the top base member 702*c*, and it may engage an opening defined in the midsole, insole, or upper member, if desired. Also, if desired, a different structure and method for securing the impact-attenuating element 702 to the remainder of the foot-receiving device structure 700 may be used without departing from the invention, including the various releasable retaining structures and methods described above (such as threaded members, turnbuckles, hook-and-loop fasteners, snap fasteners, securing straps, and the like).

FIG. 7 illustrates another option, at least in part, for securing the impact-attenuating element 702 to the remainder of the foot-receiving device structure 700 that may be used in accordance with the invention. More specifically, in this example structure, the outsole flap 710 includes a retaining extension 714 that extends around the back of the impact-attenuating element 702 and engages retaining elements or tabs 716 provided in the back of the foot-receiving device structure 700 (e.g., provided in the midsole 704, heel counter, upper member 706, etc.). In at least some examples, at least a portion of the free end of the outsole flap 710 will be made from an elastomeric material such that it stretches around the impact-attenuating element 702 to the retaining tabs 716 to more firmly hold the impact-attenuating element 702 in place. If desired, in some examples of the invention, the retaining extension 714 and retaining tab 716 combination may be the sole or primary attachment of the impact-attenuating element 702 to the midsole 704, insole, and/or upper member 706 structure(s) (e.g., the retaining plug member 708 may be omitted, if desired).

Also, if desired, plural retaining extensions 714 and retaining tab 716 combinations may be provided without departing from the invention. For example, two or more such combinations may be provided at the back of the heel area of the shoe. As still another alternative, if desired, one or more retaining extensions 714 and retaining tab 716 combinations may be provided that extend around the lateral and/or medial sides of the heel area. Other locations for such combinations also may be used without departing from the invention.

Figure 8:
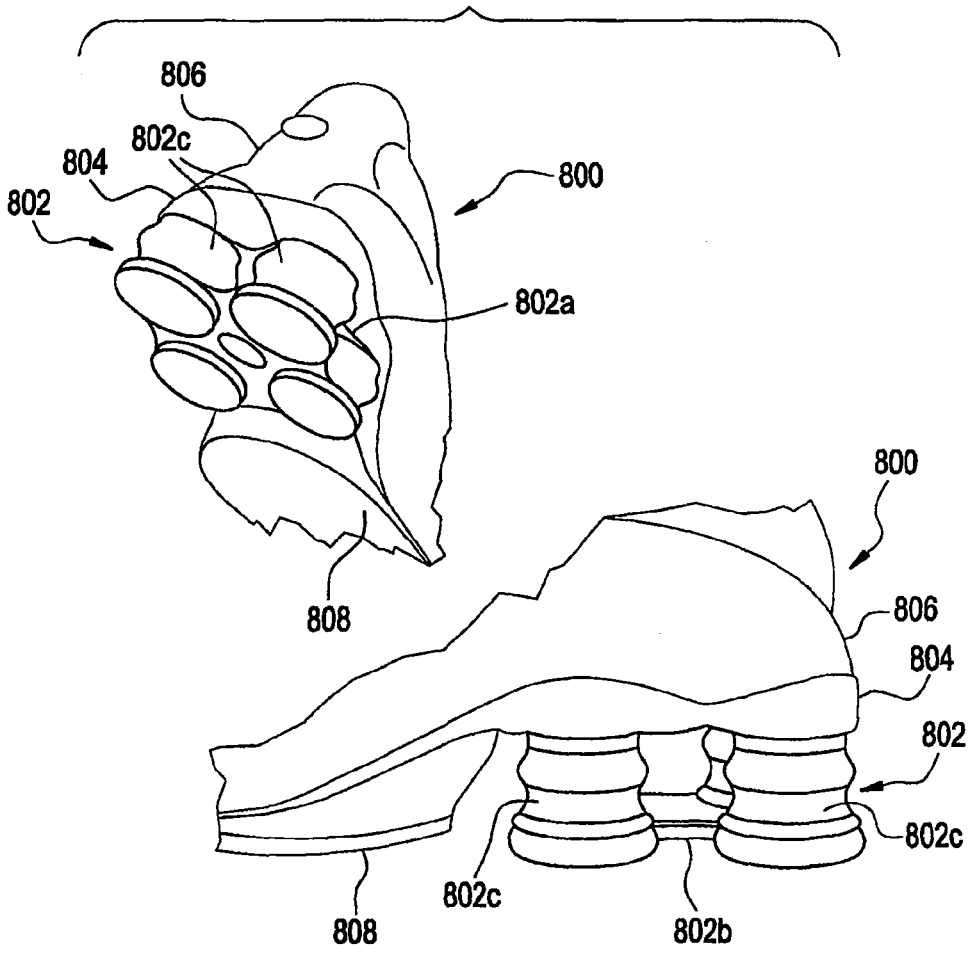

Another example structure that includes an impact-attenuating element releasably secured to the remainder of a foot-receiving device structure is illustrated in FIG. 8. In this example structure 800, the impact-attenuating device 802 is releasably secured to the midsole 804, insole (not shown), upper member 806, or other portion of the foot-receiving device structure 800 only at the top base member 802*a* of the impact-attenuating element 802. The bottom base member 802*b* of the impact-attenuating element 802, in this illustrated example, is made from materials and/or includes fraction elements so as to be suitable to directly engage the ground or other surface during use of the foot-receiving device 800. Notably, this example structure 800 does not include any direct connection or engagement between the outsole 808 and the impact-attenuating element 802 (e.g., no retaining elements, straps, snaps, hook-and-loop fasteners, or the like). If desired, bottom base member 802*b* may be omitted and the bottoms of the impact-attenuating columns 802*c* may be constructed to directly engage the ground in use.

Of course, any manner of securing the impact-attenuating element 802 to the remainder of the foot-receiving device structure 800 (e.g., to the insole, midsole 804, and/or upper member 806) may be used without departing from the invention. For example, the various ways of attaching described above may be used, such as a plug member fitting in a retaining opening, threaded members, turnbuckles, hook-and-loop fasteners, snap fasteners, securing straps, and the like. A more detailed example of a turnbuckle type fastener arrangement that may be used in connection with the structure 800 of FIG. 8 (as well as the other structures described above) is described below in conjunction with FIGS. 9A through 9C.

Figure 9A:
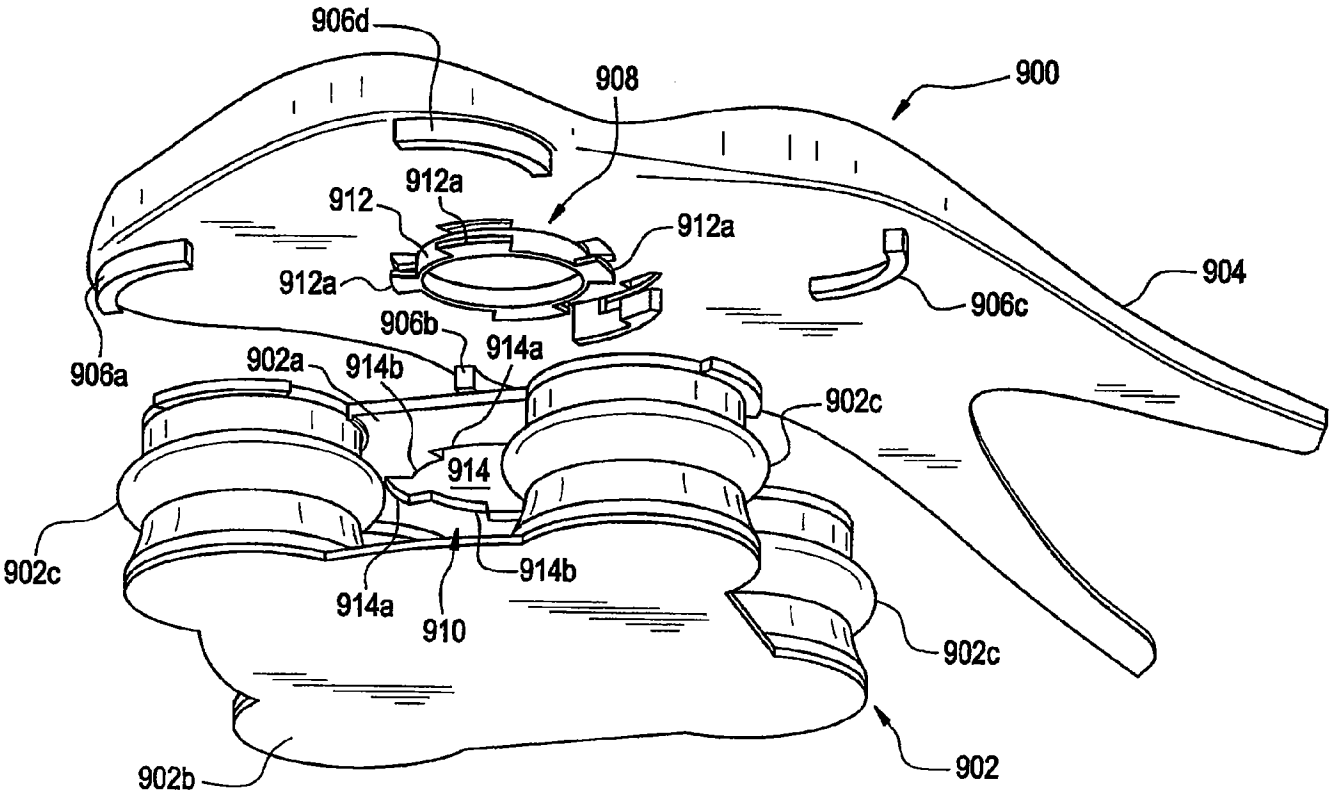
FIGS. 9A through 9C illustrate additional details of an example turnbuckle type system for releasably engaging an impact-attenuating element to a portion of a foot-receiving device.
Figure 9B:
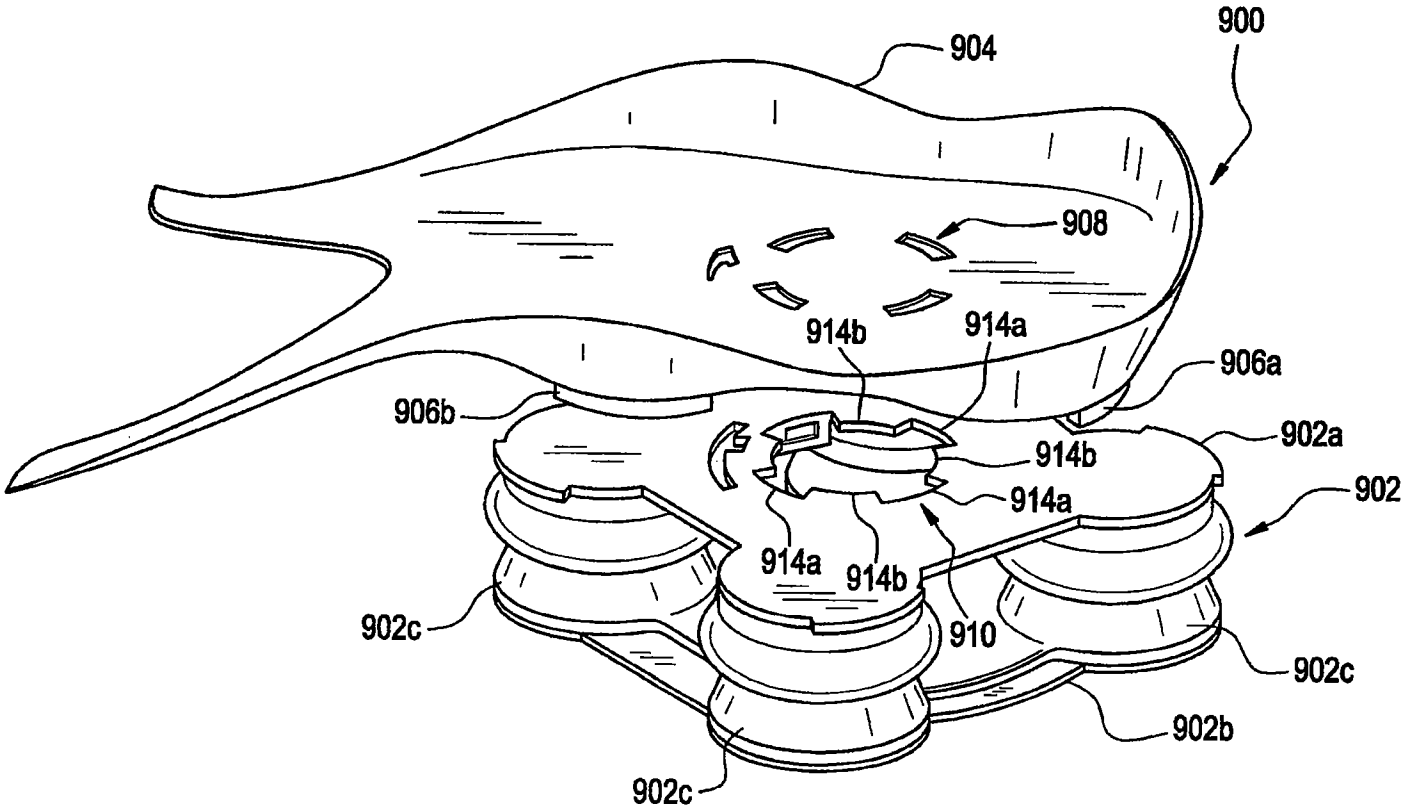
Figure 9C:
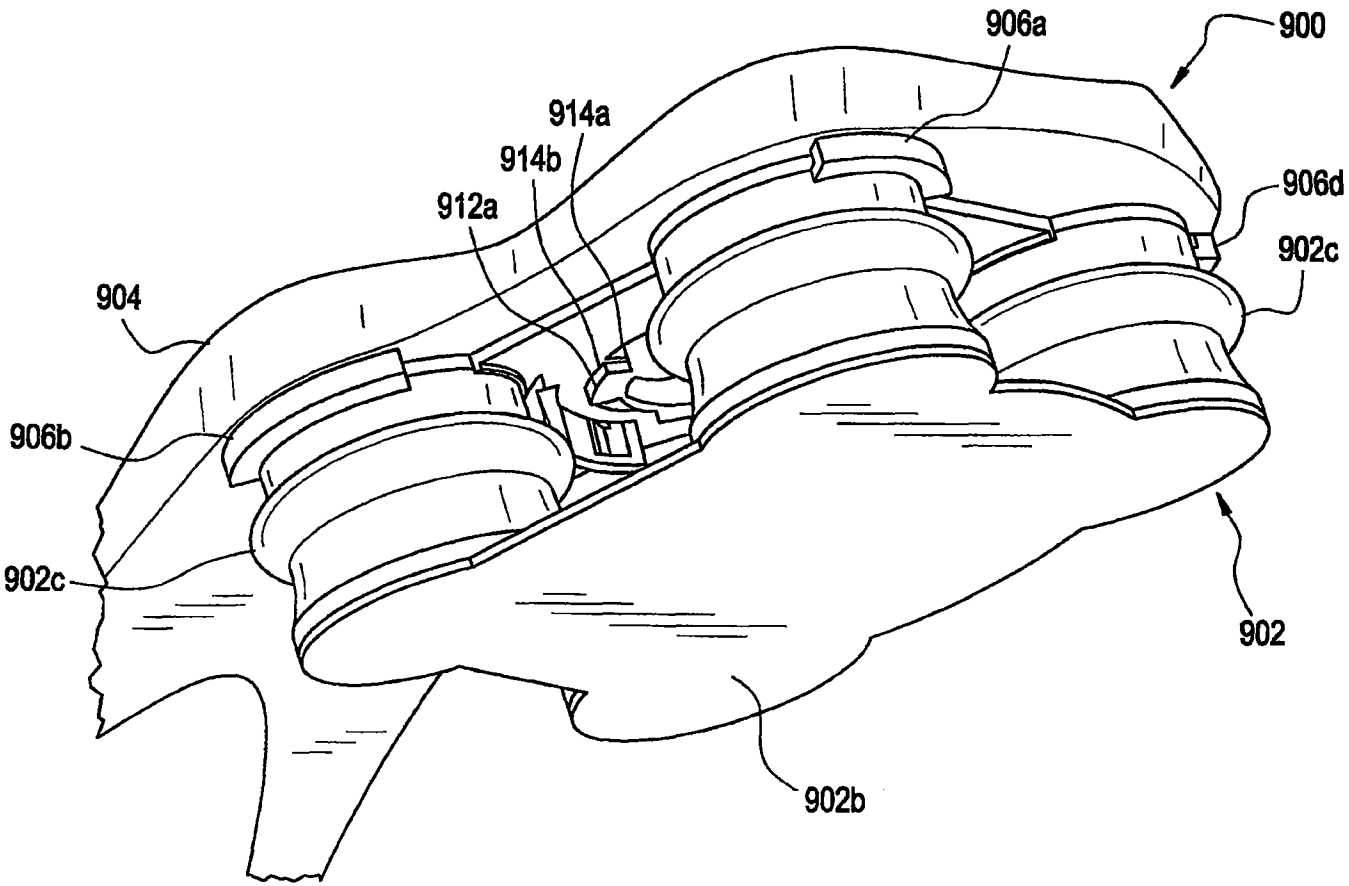

FIGS. 9A through 9C illustrate an example "turnbuckle-type" structure that may be used to secure an impact-attenuating element to another portion of a foot-receiving device structure, such as an insole, midsole, outsole, and/or upper member. As illustrated, the overall structure 900 includes an impact-attenuating element 902 and another portion of the foot-receiving device to which it is attached (in this illustrated example, the impact-attenuating element 902 is attached to a portion of a footwear midsole 904). In this example, the midsole member 904 includes outer retaining lips 906*a* through 906*d* that help retain the impact-attenuating element 902 in place with respect to the midsole member 904, although such retaining lips 906*a* through 906*d* may be omitted without departing from the invention. A central portion of the midsole member 904 includes a retaining member 908 that engages a corresponding retaining member 910 provided on the impact-attenuating element 902. These retaining members 908 and 910 are described in more detail below.

Retaining member 908 includes a raised ring member 912 that includes a plurality of tab elements 912*a*. Retaining member 910 includes an opening 914 defined in the top base member 902*a* of the impact-attenuating element 902. The outer edge of the opening 914 is defined so as to include recess areas 914*a* sized and arranged so as to allow entry of the tab elements 912*a* of retaining member 908. In use, the tab elements 912*a* are pushed through the recess areas 914*a*, and then the impact-attenuating element 902 is rotated with respect to the midsole member 904 (e.g., one-eighth or one-fourth of a complete turn) so that the tab elements 912*a* move away from the recess areas 914*a* and engage behind retaining elements 914*b* defined around the outer edge of opening 910. The tab elements 912*a*, recess areas 914*a*, and retaining elements 914*b* are arranged such that when the tab elements 912*a* are properly inserted into the recesses 914*a* and engaged with retaining elements 914*b*, the outer edge of the impact-attenuating element 902 will smoothly fit between retaining lips 906*a* through 906*d*. If desired, the retaining member 908 and/or the top surface 902*a* of the impact-attenuating element 902 may include rotation stops that prevent over-rotation of the impact-attenuating element 902 with respect to the other portion of the foot-receiving device structure.

Similarly, if desired, the impact-attenuating element 902 may be removed from the midsole member 904 (or other portion of the foot-receiving device structure 900) by turning the impact-attenuating element 902 with respect to the midsole member 904 such that the tab elements 912*a* move away from the retaining elements 914*b* and align with the recess areas 914*a*. The tab elements 912*a* then may be moved through the recess areas 914*a* to disengage the impact-attenuating element 902 from the foot-receiving device structure 904.

Of course, many variations in the structures involved in the above-described turnbuckle arrangement may be made without departing from the invention. For example, if desired, the impact-attenuating element 902 may carry the raised ring and tab elements, and the midsole member 904 (or other portion of the foot-receiving device) may define the opening, including the recess areas and retaining elements. The number, sizes, shapes, locations, orientations, and/or other characteristics of the retaining members 908 and/or openings 910 (including tabs, recesses, retaining members, etc.) may be changed and widely varied without departing from the invention.

If desired, the turnbuckle type system described in conjunction with FIGS. 9A through 9C may be the sole system that releasably engages the impact-attenuating element 902 with the remainder of the foot-receiving device structure (e.g., like the structure illustrated in FIG. 8). Alternatively, if desired, one or more other releasable engaging elements may be included in the overall foot-receiving device structure without departing from the invention, such as hook-and-loop fasteners, retaining straps, snap fasteners, etc. Also, the bottom base member 902*b* may function as a portion of the outsole for the foot-receiving device (e.g., it may include traction elements and/or be constructed of a suitable material so as to allow it to function as an outsole). Alternatively, if desired, another outsole member may cover the bottom base member 902*b* without departing from the invention. As still another example, if desired, the bottom base member 902*b* may be omitted or moved to the central portion of the impact-attenuating members 902*c*, and the bottom of impact-attenuating members 902*c* may be constructed from materials and/or include traction elements so that they could function directly as an outsole member and/or an independent outsole member may directly cover these impact-attenuating members 902*c*. Many other variations in the structures and elements involved in the foot-receiving device structure 900 are possible without departing from this invention.

Figure 10A:
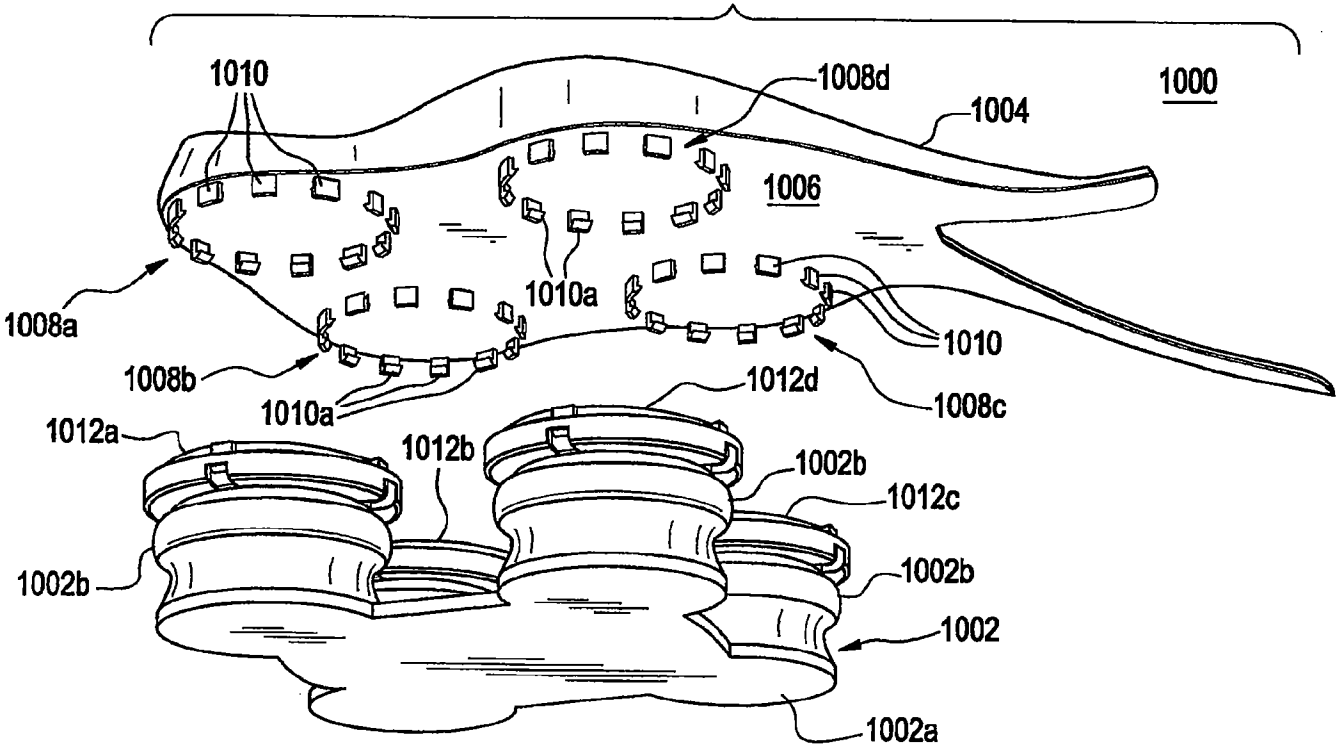
FIGS. 10A through 10C illustrate additional details of an example clip or clasp type system for releasably engaging an impact-attenuating element to a portion of a foot-receiving device.
Figure 10B:
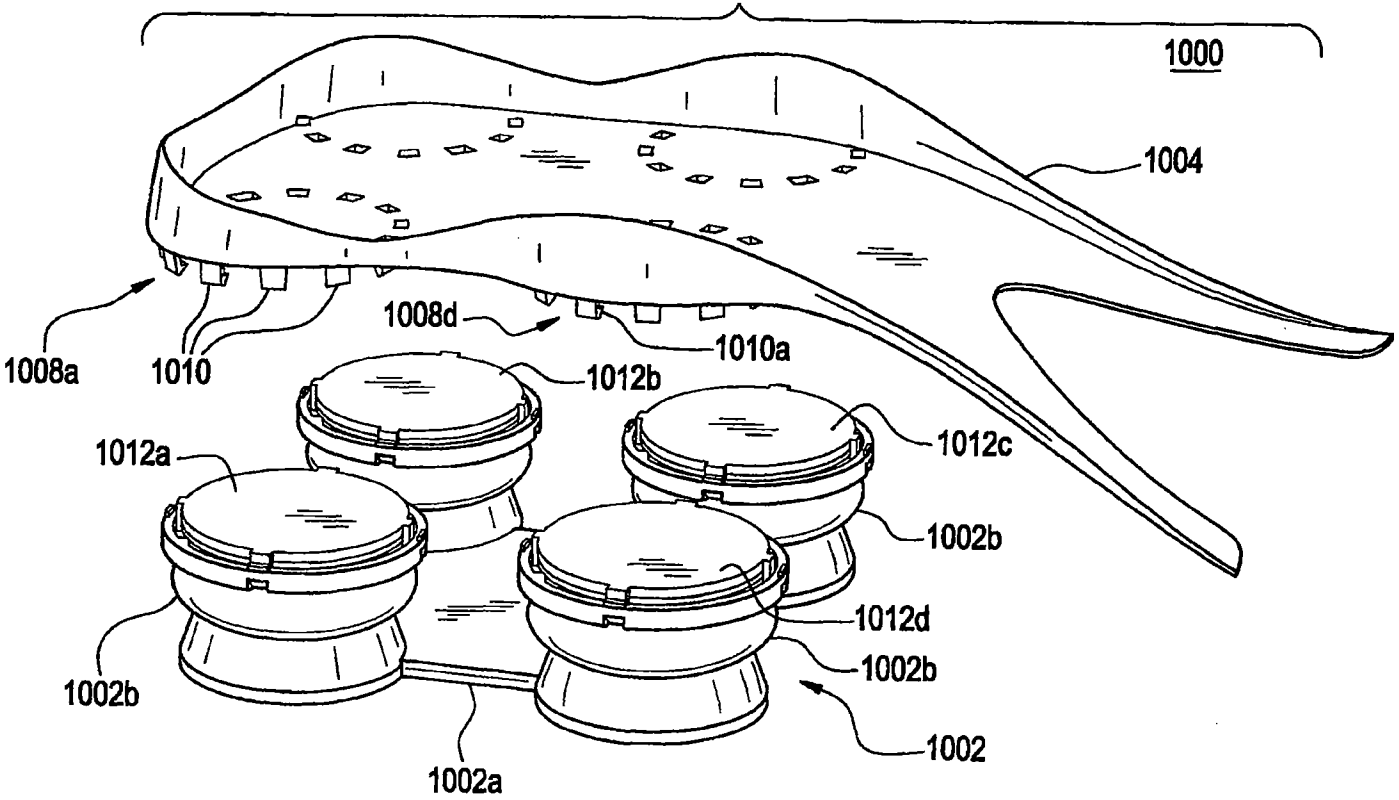
Figure 10C:
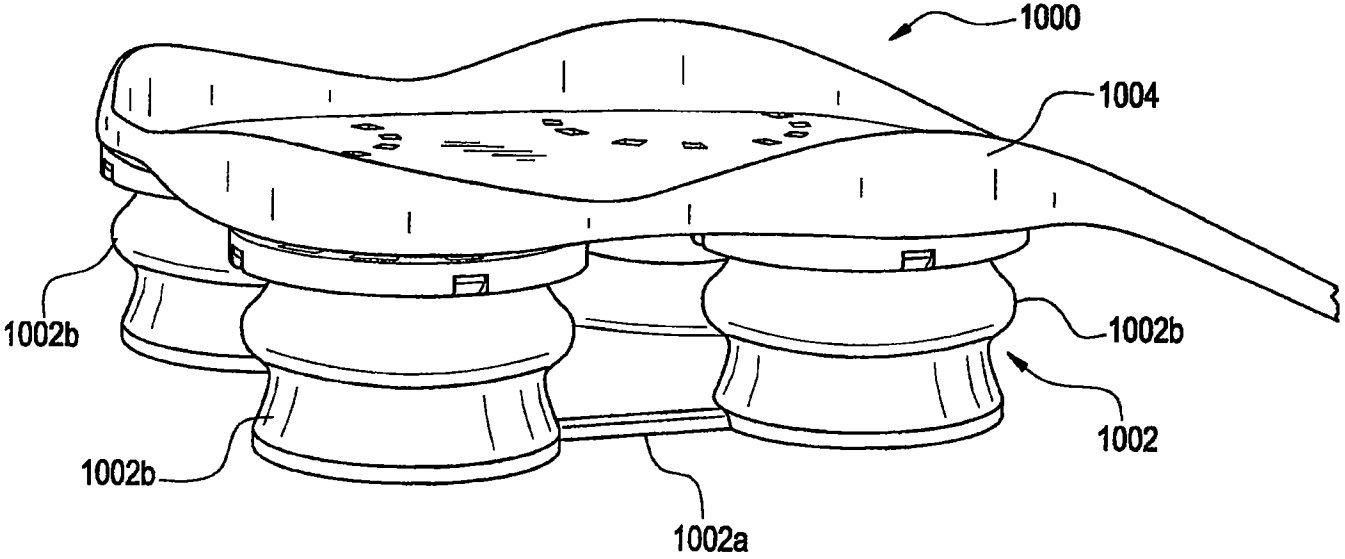

FIGS. 10A through 10C illustrate another example arrangement for releasably engaging an impact-attenuating element 1002 to the remainder of a foot-receiving device structure 1000. In this illustrated example, the impact-attenuating element 1002 is releasably engaged with a midsole member 1004, although it may be engaged with an insole member, an outsole member, an upper member, or another portion of a foot-receiving device structure without departing from the invention.

In this illustrated example, the impact-attenuating element 1002 does not include an upper or top base member, but rather, a single bottom base member 1002*a* engages and holds the impact-attenuating members 1002*b* together as a unitary structure. If desired, the base member 1002*a* may be located at an intermediate position between the tops and bottoms of impact-attenuating members 1002*b*. The midsole member 1004, in this example structure, includes a surface 1006 that has a plurality of retaining members 1008*a* through 1008*d*. Each retaining member 1008*a* through 1008*d* in this example structure includes a plurality of retaining elements 1010, which in this illustrated example include projections extending from the surface 1006. The end of each projection 1010 may include an extending lip 1010*a*.

An upper portion of each impact-attenuating member 1002*b* includes a raised ridge structure 1012*a* through 1012*d*. These raised ridges 1012*a* through 1012*d* may be integrally formed as a one piece structure with the outer surface of the impact-attenuating member structure 1002*b*, or they may be constructed as separate ring elements attached to the impact-attenuating member 1002*b* in some manner, such as through adhesives, slots, mechanical connectors, a friction fit, etc. The retaining elements 1010 are sized and arranged so as to fit over the raised ridge structures 1012*a* through 1012*d* provided with the impact-attenuating members 1002*b* such that the extending lips 1010*a* extend around their respective raised ridges 1012*a* through 1012*d* and snuggly engage the underside of these ridges 1012*a* through 1012*d*.

In at least some examples of the invention, the retaining elements 1010 will be stiff enough to firmly engage the raised ridges 1012*a* through 1012*d* and hold to them, yet resilient enough to clip or snap over the raised ridges 1012*a* through 1012*d* to engage these elements together. Additionally, the retaining elements 1010 of this example will be resilient enough to allow the retaining elements 1010 to be disengaged from the raised ridges 1012*a* through 1012*d* so that the impact-attenuating element 1002 may be removed from the midsole member 1004 (or other portion of the foot-receiving device structure).

Many variations in the retaining element 1010 and/or raised ridge structure 1012*a* through 1012*d* are possible without departing from the invention. For example, the retaining element projections 1010*a* may fit into recesses or openings provided in the raised ridge structure 1012*a* through 1012*d* and/or the impact-attenuating member structure 1002*b* and optionally then turn to engage retaining elements provided in the raised ridge structure 1012*a* through 1012*d* (e.g., akin to the turnbuckle arrangement shown in FIGS. 9A through 9D). As another example, the retaining element projections may be provided on the impact-attenuating element and suitable retaining elements may be provided on the other portion of the foot-receiving device structure (e.g., on the midsole, insole, outsole, and/or upper members). As still another example, a mechanical arrangement, such as one or more spring elements, may be provided to move (e.g., extend or constrict) the retaining elements 1010 and/or move (e.g., extend or constrict) the raised ridges 1012*a* through 1012*d* so that the impact-attenuating element 1002 may be freely and easily attached to and/or removed from the midsole member 1004 and/or still allow these elements to be firmly attached to one another.

As described above in conjunction with the structure illustrated in FIGS. 9A through 9C, the bottom base member 1002*a* of the impact-attenuating element 1002 may be exposed in the final foot-receiving device structure and may be constructed so as to function as a portion of the outsole member for the foot-receiving device (e.g., the bottom surface of base member 1002*a* may be constructed of a material and/or include traction elements so as to make it suitable for use as an outsole member). Alternatively, if desired, some or the entire bottom surface of base member 1002*a* may be covered in the final foot-receiving device structure, e.g., by a separate outsole member, without departing from the invention. As still another potential alternative, the base member 1002*a* may be moved upward in the impact-attenuating device structure 1002 and the bottom of the impact-attenuating members 1002*b* may function as the outsole for the foot-receiving device structure.

Additional aspects of this invention relate to methods for providing footwear or foot-receiving devices that include impact-attenuating element(s) of the type described above. As mentioned above, the impact-attenuating characteristics of footwear or other foot-receiving devices according to examples of this invention can be easily changed, for example, by replacing one impact-attenuating element with another having different characteristics.

Various factors may be taken into consideration when determining the specific characteristics of one or more impact-attenuating elements to place in a given piece of footwear or other foot-receiving device. For example, characteristics of the impact-attenuating element(s) may be selected based on one or more characteristics of the intended end user, such as: the user's weight, the user's shoe size, the user's foot width, the user's moving speed, the user's jumping ability, the user's stride or gait characteristics (e.g., a pronation or supination tendency, etc.), and the like. Also, the characteristics of the impact-attenuating element(s) may be selected depending on one or more characteristics of the final intended end use of the footwear or other foot-receiving device product. For example, different impact-attenuating element(s) (e.g., elements having different stiffnesses) may be selected depending on whether the footwear or foot-receiving device is used for walking, running, basketball, soccer, football, baseball, softball, sprinting, various track events, various field events, cross-training, video game play, training exercises, etc.

The potential variability features of impact-attenuating element(s) according to examples of the invention allow manufacturers, wholesalers, retailers, users, coaches, trainers, or others to selectively determine and/or change the characteristics of a piece of footwear or other foot-receiving device by selecting different impact-attenuating element(s) for inclusion in these devices. In this manner, if desired, manufacturers, wholesalers, retailers, users, or others can customize a pair of footwear or other foot-receiving device, e.g., based on one or more characteristics of the intended user, one or more characteristics of the ultimate intended end use of the product, user preference, etc. Moreover, this customization can take place at any stage in the distribution chain, for example, at the construction factory by the manufacturer, by wholesalers or retailers (e.g., at a warehouse or a point of sale location, to replenish depleted stock, etc.), by consumers at the time and/or after the product has been purchased, by trainers or coaches, etc. As one example, the characteristics of the impact-attenuation element(s) may be selected at the assembly factory for a given pair of shoes, and these shoes then may be marketed specifically targeted to specific users or use characteristics (e.g., the sales box and/or a tag on the shoe might indicate that the shoe is designed for running or jogging for a user between 165 and 180 lbs.). Shoes for a series of different uses and for different user weights (or other characteristics) then may be marked on boxes or tags (depending on the characteristics of the impact-attenuating element used) and placed in the market.

As another example, shoe retailers or wholesalers may have a supply of impact-attenuating elements available to insert into the footwear or other foot-receiving device at the point of sale location, e.g., based on the characteristics of the intended user, the intended use, user preference, to replenish depleted stock, etc. As still another example, users may be allowed to freely select and/or change impact-attenuating elements, based on their immediate needs and/or the characteristics they desire in the footwear or other foot-receiving devices (e.g., by switching one impact-attenuating element for another at a point of use location). Impact-attenuating elements labeled with various different characteristics (e.g., for different user characteristics or intended use characteristics as described above) may be made available to the users. These aspects of the invention work particularly well for footwear and foot-receiving device designs in which the impact-attenuating element(s) remain visible and/or are otherwise easily accessible by the user after the device is fully assembled.

As another example, methods according to aspects of the invention further may include providing at least an upper member and a sole member (e.g., an outsole member, a midsole member, an insole member, etc.) for a piece of footwear or other foot-receiving device. Based at least in part on a characteristic of an intended user of the piece of footwear or the device or a characteristic of an intended use of the piece of footwear or device, an impact-attenuating element may be selected or identified for inclusion in the piece of footwear or in the device. As mentioned above, this selection may occur, for example, at the manufacturing location, at a wholesaler location, at a retailer location, after retail purchase, at a point of use location, through use of an on-line internet site, etc. The selected impact-attenuating element then may be included at the desired location in the piece of footwear or other foot-receiving device, e.g., between the upper member and a portion of the sole member, attached to the upper member or a portion of the sole member, etc.

If desired, a user may change the characteristics of a piece of footwear or other foot-receiving device by removing one impact-attenuating element and replacing it with a new one. This feature also can be used for any other desired reason, e.g., to replace a broken impact-attenuating element, to customize a foot-receiving device for a new user, customize a foot-receiving device for changing user or use conditions, etc. Impact-attenuating elements of the type described above also may be provided in the arch area of a foot-receiving device to provide support for the arch, if desired.

Figure 11A:
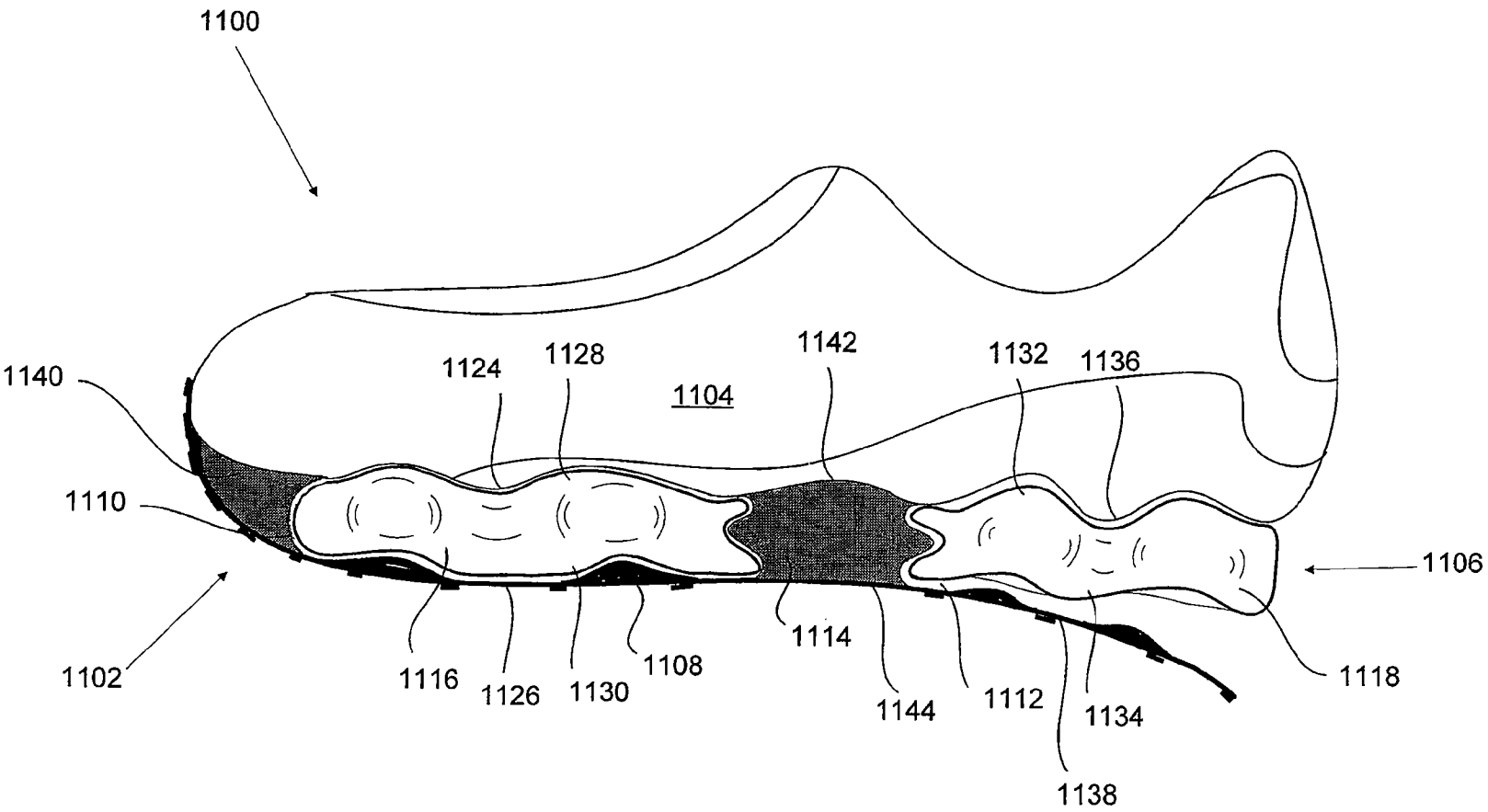
FIGS. 11A and 11B illustrate an article of footwear having a sole structure for receiving removable inserts, according to examples of this invention.
Figure 11B:
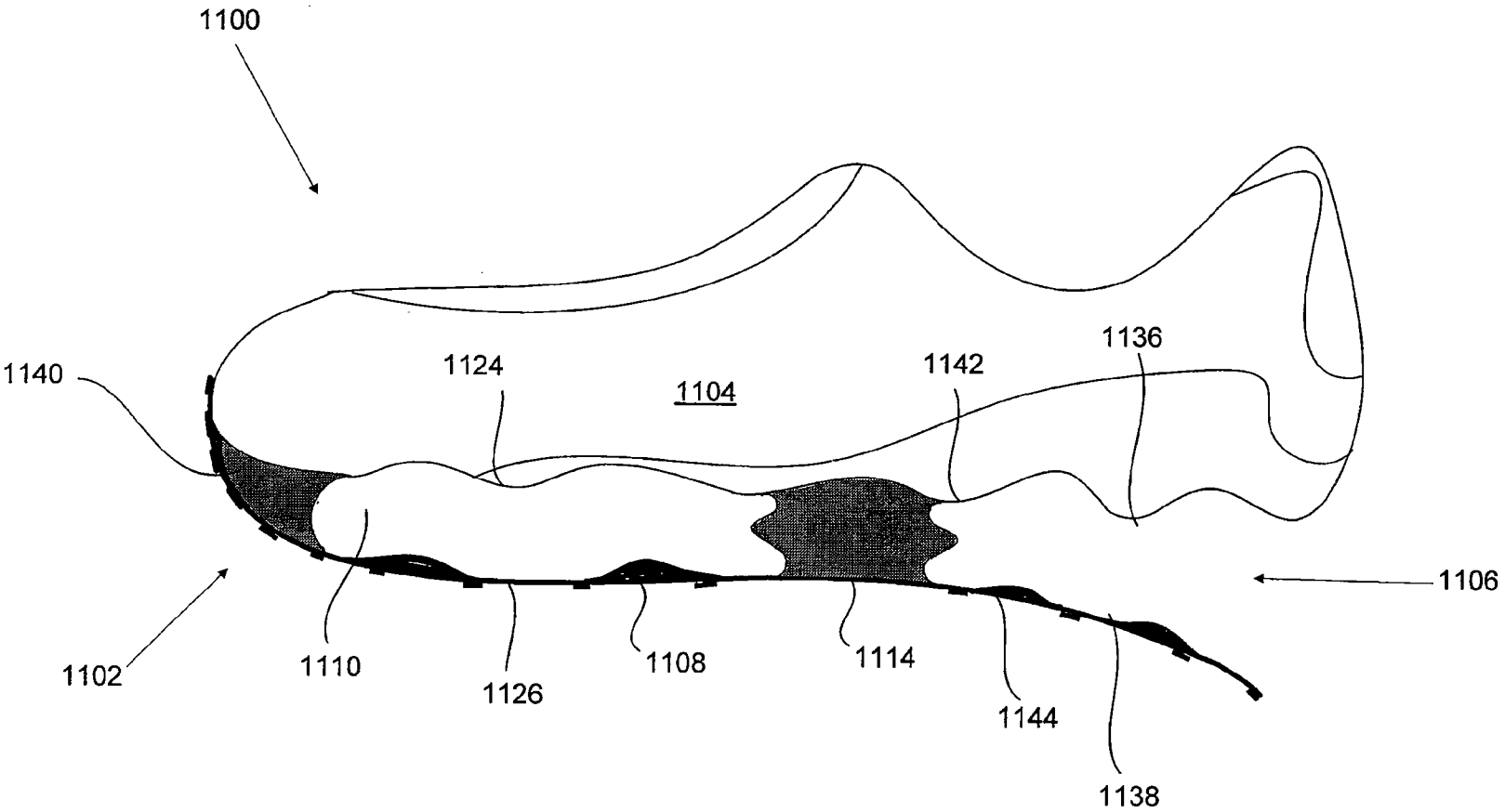

FIGS. 11A and 11B illustrate an article of footwear 1100 having a sole structure 1102 and an upper 1104. The sole structure 1102 comprises a midsole 1106 and an outsole 1108. The sole structure 1102 has a first opening 1110 in the forefoot region and a second opening 1112 in the heel region. A column 1114 in the midfoot region separates the first opening 1110 from the second opening 1112. The column 1114 provides structural support between the upper 1104 and the outsole 1108. The column 1114 holds the upper 1104 and the outsole 1108 apart a distance and permits the first opening 1110 and the second opening 1112 to remain the spaced apart from each other. The footwear 1100 illustrated in FIG. 11A includes a forefoot removable insert 1116 and a heel removable insert 1118. The forefoot removable insert 1116 is inserted into the first opening 1110 and the heel removable insert 1118 is inserted into the second opening 1112. The footwear 1100 illustrated in FIG. 11B includes a sole structure 1102 with the forefoot removable insert 1116 and the heel removable insert 1118 removed.

Figure 12:
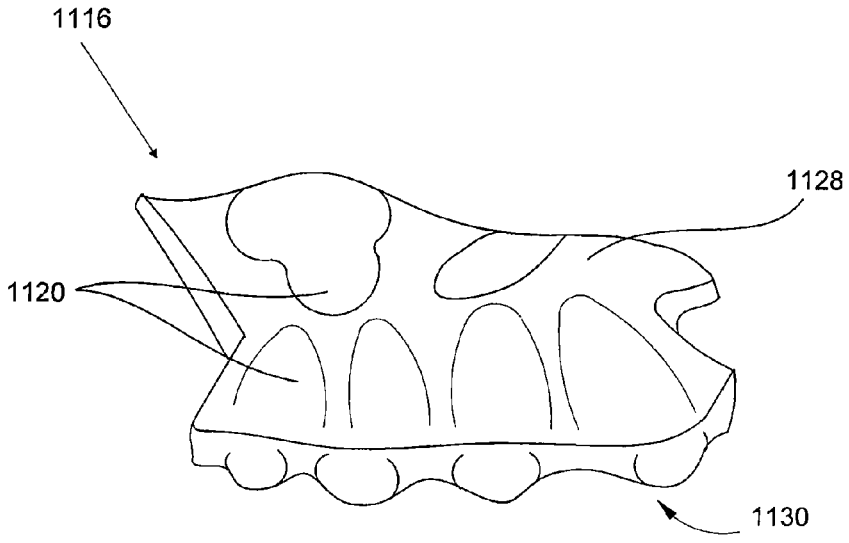
FIG. 12 illustrates an example of a forefoot region removable insert for the article of footwear illustrated in FIGS. 11A and 11B, according to examples of this invention.
Figure 13:
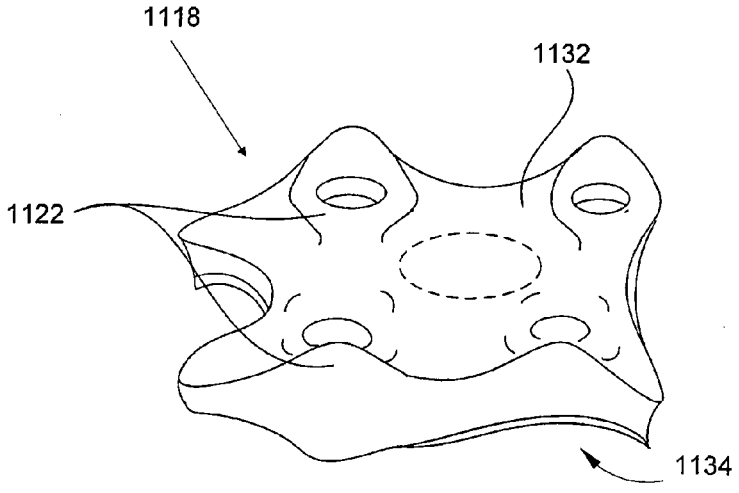
FIG. 13 illustrates an example of a heel region removable insert for the article of footwear illustrated in FIGS. 11A and 11B.

FIG. 12 illustrates an example forefoot removable insert 1116. FIG. 13 illustrates an example heel removable insert 1118. FIGS. 12 and 13 illustrate the shapes of the surfaces 1120, 1122 of the forefoot removable insert 1116 and the heel removable insert 1118, respectively. The first opening 1110 in the article of footwear 1100 is shaped in a complementary fashion to the shape 1120 of the forefoot removable insert 1116, as illustrated in FIGS. 11A and 11B. The second opening 1112 in the article of footwear 1000 is shaped in a complementary fashion to the shape 1122 of the heel removable insert 1118, as illustrated in FIGS. 11A and 11B. FIG. 11A illustrates the forefoot removable insert 1116 and the heel removable insert 1118 inserted into the first opening 1110 and the second opening 1112, respectively. More specifically, the first opening 1110 has a top surface 1124 and a bottom surface 1126. The forefoot removable insert 1116 also has a top surface 1128 and a bottom surface 1130. FIG. 11A and FIG. 12 illustrate the curved configuration of the top and bottom surfaces 1128, 1130 of the forefoot removable insert 1116. The top and bottom surfaces 1124, 1126 of the first opening 1110 also have curved configurations and are complementary in shape to the curved configurations of the top and bottom surfaces 1128, 1130 of the forefoot removable insert 1116. This complementary configuration permits the top surface 1128 of the forefoot removable insert 1116 to be positioned adjacent to, if not in physical contact with the top surface 1124 of the first opening 1110. The complementary configuration of the forefoot removable insert 1116 with the first opening 1110 provides a mechanical interface between the forefoot removable insert 1116 and the sole structure 1102.

Similarly, FIG. 11A and FIG. 13 illustrate top and bottom surfaces 1132, 1134, respectively, of the heel removable insert 1118 having a curved configuration. Top and bottom surfaces 1136, 1138 of the second opening 1112 also have a curved configuration. They are complementary to the curved configuration of the top and bottom surfaces 1132, 1134 of the heel region removable insert 1118. This complementary configuration permits the top surface 1132 of the heel removable insert 1118 to be positioned adjacent to, if not in physical contact with the top surface 1136 of the second opening 1112. The complementary configuration of the heel removable insert 1118 with the second opening 1112 provides a mechanical interface between the heel removable insert 1118 and the sole structure 1102.

The mechanical interfaces between the forefoot removable insert 1116 and the sole structure 1102 and the heel removable insert 1118 and the sole structure 1102 help to secure the forefoot removable insert 1116 and the heel removable insert 1118 in place within the first opening 1110 and the second opening 1112, respectively, of the sole structure 1102. The mechanical interface helps to prevent slip or slide between the forefoot and heel removable insert 1116, 1118 and the sole structure 1102.

FIGS. 11A and 11B illustrate that the first opening 1110 in this example structure according to the invention is an enclosed space defined by a toe column 1140, the top surface 1124 of the first opening 1110 (proximate to a bottom surface 1142 of the upper 1104 in the forefoot region), the midfoot column 1114, and the bottom surface 1126 of the first opening 1110 (proximate to a top surface of the outsole 1144 in the forefoot region). The forefoot removable insert 1116 is inserted into the first opening 1110 from the lateral or the medial side of the sole structure 1102 in this example, although the forefoot removable insert 1116 may be inserted into the first opening 1110 in any suitable fashion. Due to the flexible and resilient nature of the material of the insert 1116, it can be inserted into the first opening 1110 by folding and/or compressing it, and then the material of the insert 1116 will re-expand to fill or substantially fill the opening 1110. FIGS. 11A and 11B also illustrate the second opening 1112 as being defined by the midfoot column 1114, the top surface 1136 of the second opening 1112 (proximate to a bottom surface 1142 of the upper 1104 in the heel region), and the bottom surface 1138 of the second opening 1112 (proximate to a top surface of the outsole 1144 in the heel region). In this example, the second opening 1112 has a fourth "side" defined by an open space. It remains unattached to another portion of the footwear 1100. The outsole 1108 may be peeled away from the upper 1104 and the rest of the sole structure 1102 to increase the size of the space of the fourth "side." This "increased size" of the fourth side provides space for the heel removable insert 1118 to be inserted into the second opening 1112 with relative ease. The outsole 1108 may be secured to the footwear 1100 in any suitable fashion. In some examples, a mechanical connector (or optionally a selectively releasable mechanical connector), e.g., like any of those described above, may be used to secure the outsole 1108 to the footwear 1100.

Figure 14:
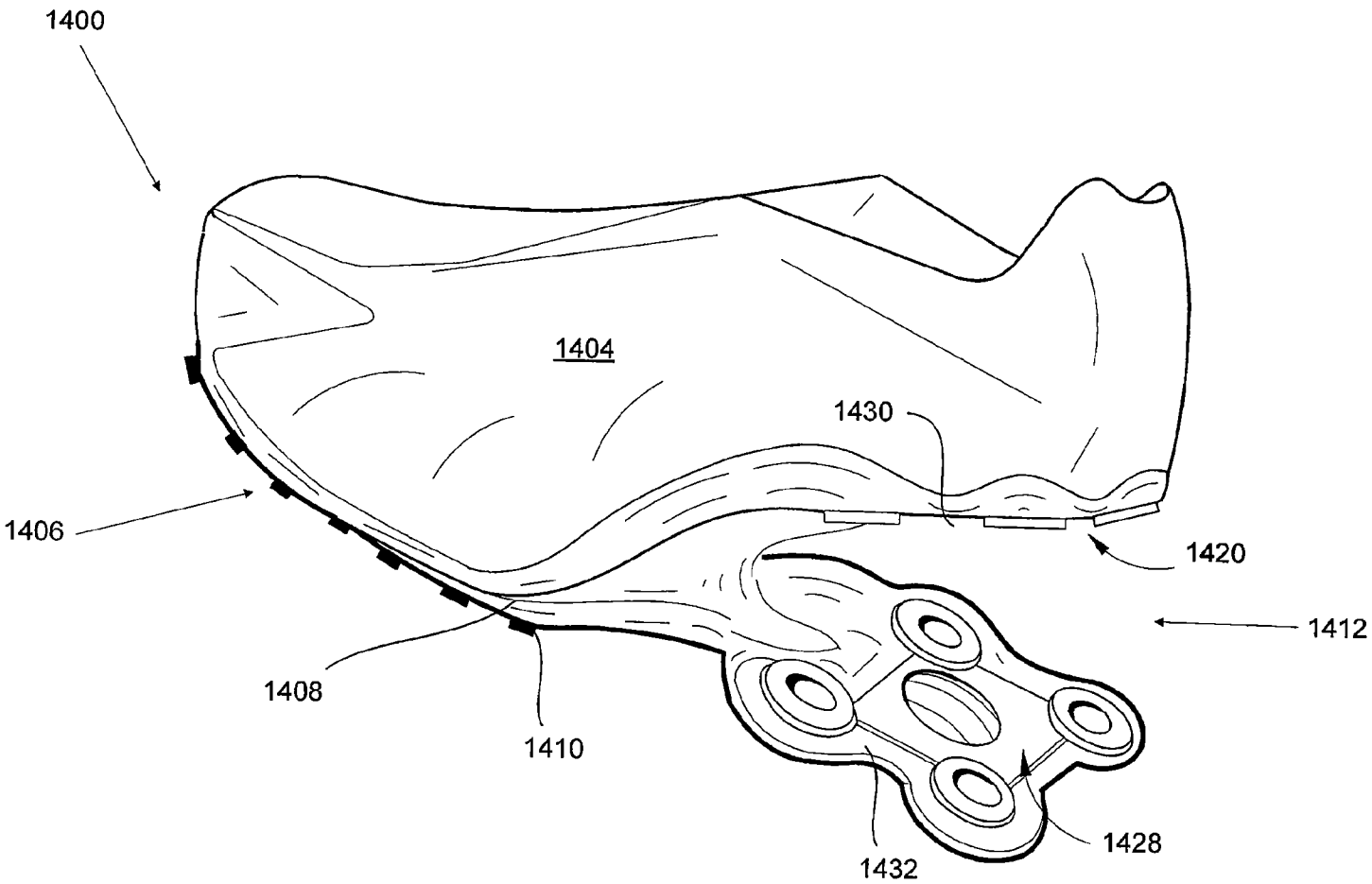
FIG. 14 illustrates another example article of footwear having a sole structure that has an opening for receiving a removable insert, according to examples of the invention.
Figure 15:
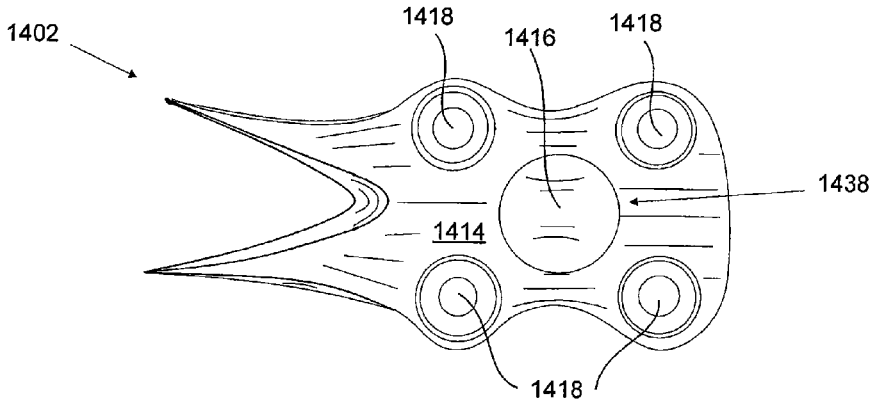
FIG. 15 illustrates a top plan view of the heel region insert for the article of footwear illustrated in FIG. 14.
Figure 16:
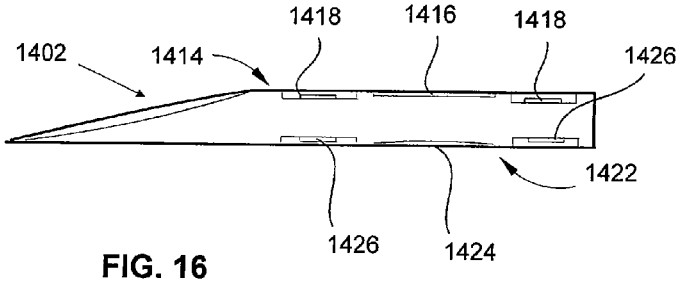
FIG. 16 illustrates a side view of the heel region insert for the article of footwear illustrated in FIG. 14.
Figure 17:
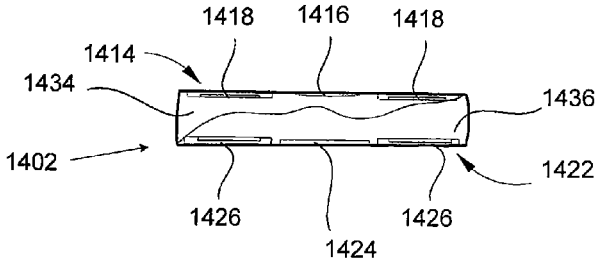
FIG. 17 illustrates a back view of the heel region insert for the article of footwear illustrated in FIG. 14.
Figure 18:
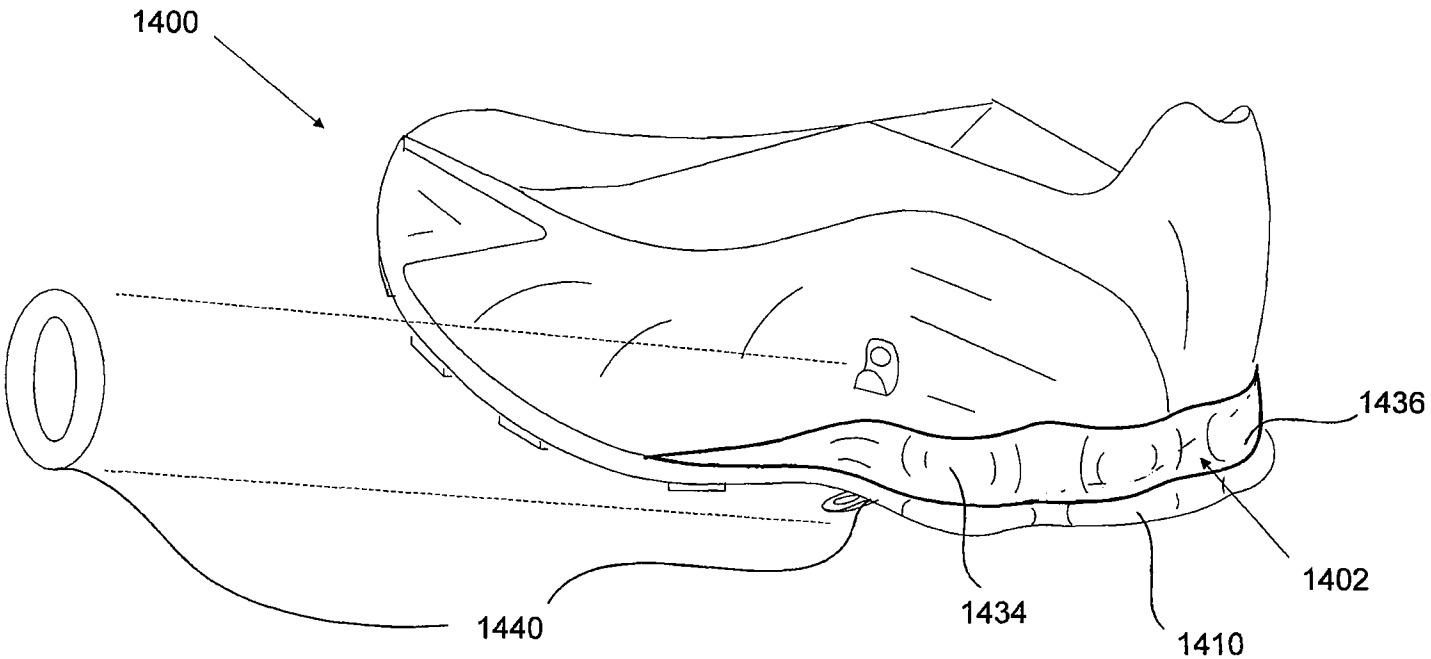
FIG. 18 illustrates the article of footwear illustrated in FIG. 14 with the heel region insert inserted into the sole structure, according to aspects of the invention.

FIGS. 14-18 illustrate a second embodiment of an article of footwear 1400 with a removable insert 1402. FIG. 14 illustrates an article of footwear 1400 having an upper 1404 and a sole structure 1406 attached thereto. The sole structure 1406 comprises a midsole 1408 and an outsole 1410. The sole structure 1406 has an opening 1412 in the heel region for receiving a heel removable insert 1402. FIGS. 15-17 illustrate the heel removable insert 1402 that is inserted into the opening 1412 of the sole structure 1406. FIG. 18 illustrates the heel removable insert 1402 positioned within the opening 1412 of the sole structure 1406. The top surface 1414 of the heel removable insert 1402 illustrated in FIGS. 15-17 has a center region indentation 1416 located approximately in the center region 1438 of the heel removable insert 1402. The top surface 1414 also has four cut-outs 1418 spaced evenly around the center region indentation 1416. The center region indentation 1416 and the four cut-outs 1418 of the top surface 1414 mate with a top surface 1420 of the opening 1412 (i.e., the top surface 1420 of the opening 1412 has a complementary shape to the top surface 1414 of the heel removable insert 1402).

A bottom surface 1422 of the heel removable insert 1402 illustrated in FIGS. 16-17 has a center region indentation 1424 and four cut-outs 1426 evenly spaced therearound. FIG. 14 illustrates an article of footwear 1400 having an opening 1412 with a bottom surface 1428 that is shaped in a complementary fashion to the bottom surface 1422 of the heel removable insert 1402. When the removable insert 1402 is inserted into the opening 1412, as illustrated in FIG. 18, the top surface 1414 of the heel removable insert 1402 is positioned adjacent to the top surface 1420 of the opening 1412 (proximate to, or even in physical contact with, a bottom surface 1430 of the upper 1404) and the bottom surface 1422 of the heel removable insert 1402 is positioned adjacent to the bottom surface 1428 of the opening 1412 (proximate to, or even in physical contact with a top surface 1432 of the outsole 1410). The complementary configuration of the heel removable insert 1402 with the opening 1412 provides a mechanical interface between the heel removable insert 1402 and the sole structure 1406. The mechanical interface between the heel removable insert 1402 and the sole structure 1406 helps to secure the heel removable insert 1402 in place within the sole structure 1406. The mechanical interface helps to prevent slip or slide between the heel removable insert 1402 and the sole structure 1406.

FIGS. 16 and 17 illustrate a side view and a back plan view, respectively, of the heel removable insert 1402. As discussed above, the top surface 1414 and the bottom surface 1422 both have center region indentations 1416, 1424, respectively, and surrounding cut-outs 1418, 1426, respectively. The heel removable insert 1402 illustrated in FIGS. 16 and 17 has a first portion 1434 and a second portion 1436 having different properties. The first portion 1434 and the second portion 1436 include a compressible foam material in this example. The compressible foam material of the first portion 1434 is harder than the compressible foam material of the second portion 1436. The first portion 1434 is positioned on the lateral side of the sole structure 1406 and is tapered toward the center region 1438 of the heel removable insert 1402. The second portion 1436 is positioned on the medial side of the sole structure 1406 and is tapered as it extends towards the center region 1438 of the heel removable insert 1402. The first portion 1434 and the second portion 1436 are shaped as wedges. This wedge configuration is illustrated in FIG. 17.

FIG. 18 illustrates the article of footwear 1400 illustrated in FIG. 14 with the heel removable insert 1402 inserted into the opening 1412 and a mechanical connector 1440 that secures the outsole 1410 to the upper 1404. The heel removable insert 1402 is inserted into the opening 1412 such that the first portion 1434 is positioned on the lateral side of the heel removable insert 1402 and tapers towards the center region 1438. In this configuration, the wearer will first strike the ground with the lateral edge of the heel region of the sole structure during a normal walk/run cycle, which will result in the initial heel strike occurring with a portion of the sole structure with the hardest compressible foam.

The articles of footwear with removable inserts that are illustrated in FIGS. 11A-18 are examples of footwear that may be used in various methods described above. For example, the footwear illustrated in FIGS. 11A-18 may be used in the methods of testing the footwear products, training testers of footwear products, customizing footwear products, and the like, as described above. The methods, as applied to the example footwear in FIGS. 11A-18, permit a wearer to easily remove and exchange impact attenuating inserts, to thereby facilitate easy testing and customizing of various aspects of the sole structure of an article of footwear.

For example, manufacturers (or any other developer of footwear products) may solicit assistance from one or more wearers in testing one or more footwear products. The manufacturers may provide the wearer(s) with one or more articles of footwear with removable insert(s). For example, the manufacturers may provide a wearer with an article of footwear containing a sole structure with a forefoot removable insert and a heel removable insert, such as the inserts illustrated in FIGS. 11A and 11B. The wearer may be provided with one or more forefoot removable inserts, such as the insert illustrated in FIG. 12. Each of the forefoot removable inserts may be approximately the same size and shape and may be interchangeable within the first opening of the forefoot region of the sole structure. Each of the heel removable inserts may be approximately the same size, weight, and shape and may be interchangeable within the second opening of the heel region of the sole structure. The article of footwear and one or more forefoot removable inserts and heel removable inserts may be provided to the wearer(s) in the form of a kit, a retail product, a testing facility, and the like. The wearer may be provided a first, second, and third, forefoot removable insert, each being of approximately the same size, weight, and shape. The wearer also may be provided a first, second, and third heel removable insert, each being of approximately the same size, weight, and shape. The wearer may "test" each of the forefoot removable inserts and the heel removable inserts. The wearer may mix and match the combinations of the first, second, and third forefoot removable inserts and the first, second, and third heel removable inserts to determine the overall shoe construction that they find the wearer finds the most comfortable or desirable for the activities in which they will engage.

In another example, the manufacturers may provide a wearer with an article of footwear containing a sole structure with a heel region removable insert, as illustrated in FIGS. 14 and 18. The wearer may be provided with one or more removable inserts that are each approximately the same size, weight, and/or shape. The heel removable inserts may be interchangeable within the opening of the heel region of the sole structure. The mechanical connector illustrated in FIG. 18 may be selectively secured. In its unsecured position, the opening in the heel region of the sole structure may be increased in size, which will permit easy removal and exchange of the heel removable insert from the sole structure.

The process of interchanging removable inserts from the sole structure of an article of footwear permits wearers to test one or more removable inserts in the sole structure and/or customize the sole structure for an article of footwear, as described above. For testing purposes, the wearer may record information in a tangible medium of expression in the form of at least a descriptive analysis of the insert's performance, characteristics, and/or any other information relating to the insert or comparing the insert to one or more other inserts. The wearer may be instructed regarding the method of removing an insert and inserting another insert into the sole structure of an article of footwear. The instruction may be written, verbal, electronic, or any other form of instruction. The wearer also may proceed through a self-guided method of removing an insert and inserting another insert into the sole structure of an article of footwear. Any of the methods above relating to inserting a removable insert into a sole structure of an article of footwear, removing it, and then inserting a second removable insert into the sole structure may be performed with any of the example articles of footwear illustrated in FIGS. 11A-18.

The exemplary articles of footwear illustrated in FIGS. 11A-18 also may be used in methods of training testers. A tester or a group of testers may be provided an article of footwear containing a sole structure with: (1) an opening in the forefoot region and an opening in the heel region (such as the examples illustrated in FIGS. 11A and 11B); or (2) an opening in the heel region (such as the examples illustrated in FIGS. 14 and 18). Various removable inserts having different characteristics and/or properties may be inserted into the openings in the sole structure. The removable inserts for the forefoot region (in the examples illustrated in FIGS. 11A and 11B) may each be approximately the same shape, weight, and size. Likewise, the removable inserts for the heel region (in the examples illustrated in FIGS. 11A and 11B and FIGS. 14 and 18) may each be approximately the same shape, weight, and size. The tester may be asked to proceed or may self-guide through a method of inserting the insert(s) into the sole structure and recording information in a tangible medium of expression that relates to or compares characteristics of the inserts. The tester(s) may provide a descriptive analysis (e.g., an objective valuation) of various characteristics of each insert. The tester(s) may compare the descriptive analysis of one or more of the inserts. The descriptive analysis provided by a tester may be compared to a standardized descriptive analysis (a predetermined analysis created by the manufacturers/developers that is used as a reference upon which to base other descriptive analyses). The descriptive analyses that are provided by the tester are compared to the standardized descriptive analyses. One or more ratings may be assigned to the tester based on the comparison of the tester's descriptive analysis of an insert and the standardized descriptive analysis of the same insert. Based on the rating(s) assigned to the tester and/or based on the descriptive analysis provided by the tester, the tester may be selected for inclusion in a product test group for footwear products. This process trains or "evaluates" a tester's skills in providing descriptive analysis about the sole structure of an article of footwear. In this process, the tester may be provided any of the exemplary footwear illustrated in FIGS. 11A and 11B and/or FIGS. 14 and 18.

D. CONCLUSION

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A method of comparing removable inserts used during an athletic activity, comprising:

instructing a first wearer to insert into a sole structure of an article of footwear a first removable insert having a first set of characteristics, the first removable insert being inserted into at least one of a forefoot region, a midfoot region, and a heel region;

instructing the first wearer to perform at least one athletic activity while wearing the article of footwear containing the sole structure with the first removable insert;

instructing the first wearer to remove the first removable insert from the sole structure;

instructing the first wearer to insert into the sole structure a reference removable insert having a reference set of characteristics that are different from the first set of characteristics, each of the reference characteristics having a reference value that is a value on a scale, the scale and value being assigned by another party, the reference removable insert being inserted into the at least one of a forefoot region, a midfoot region, and a heel region of the sole structure;

instructing the first wearer to perform the at least one athletic activity while wearing the article of footwear containing the sole structure with the reference removable insert;

instructing the first wearer to compare the first set of characteristics to the reference set of characteristics and assign values for the first characteristics on the scale; and instructing the first wearer to record information in a tangible medium of expression relating to a comparison of the scaled values of the first set of characteristics and the reference set of characteristics.

2. The method recited in claim 1, further comprising, offering to the first wearer the option to select for a custom designed article of footwear the first removable insert with the first set of characteristics or the reference removable insert with the reference set of characteristics.

3. The method recited in claim 1, wherein the first removable insert is inserted into at least one of a forefoot region and a heel region of the sole structure.

4. The method recited in claim 1, wherein the sole structure includes a midsole and an outsole and wherein the first removable insert comprises at least a portion of the midsole.

5. The method recited in claim 1, wherein the step of recording information includes:

instructing the first wearer to provide descriptive analysis of the performance of the first removable insert during the at least one athletic activity; and instructing the first wearer to provide descriptive analysis of the performance of the reference removable insert during the at least one athletic activity.

6. The method recited in claim 5, wherein the descriptive analysis of the first removable insert includes wearer generated information relating to at least one of: resilience, hardness, stability, support, and grip of the article of footwear.

7. The method recited in claim 1, wherein the step of recording information includes:

instructing the first wearer to assign a first rating to the first removable insert based at least in part on at least one of the first set of characteristics; and instructing the first wearer to assign a second rating to the reference removable insert based at least in part on at least one of the reference set of characteristics.

8. The method recited in claim 7, further comprising permitting the first wearer to select for inclusion in the article of footwear either the first removable insert or the reference removable insert, the selection being based at least in part on the first rating and the second rating.

9. The method recited in claim 1, wherein the first removable insert and the second removable insert are inserted into the heel region of the sole structure.

10. The method recited in claim 1, wherein the first removable insert and the reference removable insert are inserted into the forefoot region of the sole structure.

11. The method recited in claim 1, wherein the first removable insert and the reference removable insert are inserted into the heel region of the sole structure, and further comprising:

instructing the first wearer to insert a third removable insert having a third set of characteristics into the forefoot region of the sole structure;

instructing the first wearer to perform the at least one athletic activity while wearing the article of footwear containing the sole structure with the third removable insert;

instructing the first wearer to remove the third removable insert from the forefoot region of the sole structure;

instructing the first wearer to insert a fourth removable insert having a fourth set of characteristics into the forefoot region of the sole structure;

instructing the first wearer to perform the at least one athletic activity while wearing the article of footwear containing the sole structure with the fourth removable insert; and recording information in a tangible medium of expression relating to or comparing the third set of characteristics and the fourth set of characteristics.

12. The method recited in claim 1, further comprising:

providing to the first wearer an option to design a custom article of footwear that includes either the first removable insert or the reference removable insert; and receiving a request to manufacture the custom article of footwear.

13. The method recited in claim 1, wherein the first removable insert comprises a first portion and a second portion, and wherein the first portion and the second portion have different properties.

14. The method recited in claim 13, wherein the first portion comprises approximately 50% of the first removable insert.

15. The method recited in claim 13, wherein the first portion is a wedge that tapers from the lateral side of the first removable insert toward a center region of the first removable insert and the second portion is a wedge that tapers from the medial side of the first removable insert toward the center region, such that the center region comprises both the first portion and the second portion.

16. A method of comparing removable inserts used during an athletic activity, comprising:

inserting into a sole structure of an article of footwear a first removable insert having a first set of characteristics, the first removable insert being inserted into at least one of a forefoot region, a midfoot region, and a heel region of the sole structure;

performing at least one athletic activity while wearing an article of footwear containing the sole structure with the first removable insert;

removing the first removable insert from the sole structure;

inserting into the sole structure a reference removable insert having a reference set of characteristics that are different than the first set of characteristics, each of the reference set of characteristics having a reference value that is a value on a scale, the scale and value being assigned by another party, wherein the reference insert is inserted into the at least one of a forefoot region, a midfoot region, and a heel region of the sole structure;

performing the at least one athletic activity while wearing the article of footwear containing the sole structure with the reference removable insert;

comparing the first set of characteristics to the reference set of characteristics and assign values for the first characteristics on the scale; and recording information in a tangible medium of expression relating to a comparison of the scaled values of the first set of characteristics and the reference set of characteristics.

17. The method recited in claim 16, wherein the step of recording information includes comparing the first set of characteristics to the reference set of characteristics.

18. The method recited in claim 16, wherein the reference set of characteristics is a reference set of characteristics associated with a reference removable insert.

19. The method recited in claim 16, further comprising, selecting for a custom designed article of footwear the first removable insert with the first set of characteristics or the reference removable insert with the reference set of characteristics.

20. The method recited in claim 16, wherein the first removable insert is inserted into at least one of a forefoot region and a heel region of the sole structure.

21. The method recited in claim 16, wherein the sole structure includes a midsole and an outsole and wherein the first removable insert comprises at least a portion of the midsole.

22. The method recited in claim 16, wherein the step of recording the information includes:

providing descriptive analysis of the performance of the first removable insert during the at least one athletic activity; and providing descriptive analysis of the performance of the reference removable insert during the at least one athletic activity.

23. The method recited in claim 22, wherein the descriptive analysis of the performance of the first removable insert includes information relating to at least one of: resilience, hardness, stability, support, and grip of the article of footwear.

24. The method recited in claim 16, wherein the step of recording the information includes:

assigning a first rating to the first removable insert based at least in part on at least one of the first set of characteristics; and assigning a second rating to the reference removable insert based at least in part on at least one of the reference set of characteristics.

25. The method recited in claim 24, further comprising, selecting for inclusion in the article of footwear either the first removable insert or the reference removable insert, the selection being based at least in part on the first rating and the second rating.

26. The method recited in claim 16, wherein the first removable insert and the second removable insert are inserted into the heel region of the sole structure.

27. The method recited in claim 16, wherein the first removable insert and the reference removable insert are inserted into the forefoot region of the sole structure.

28. The method recited in claim 16, wherein the first removable insert and the reference removable insert are inserted into the heel region of the sole structure, and further comprising:

inserting a third removable insert having a third set of characteristics into the forefoot region of the sole structure;

performing the at least one athletic activity while wearing the article of footwear containing the sole structure with the third removable insert;

removing the third removable insert from the forefoot region of the sole structure;

inserting a fourth removable insert having a fourth set of characteristics into the forefoot region of the sole structure;

performing the at least one athletic activity while wearing the article of footwear containing the sole structure with the fourth removable insert; and comparing the third set of characteristics with the fourth set of characteristics.

29. The method recited in claim 16, further comprising:

designing a custom article of footwear that includes either the first removable insert or the reference removable insert; and sending a request to manufacture the custom article of footwear.

30. The method recited in claim 16, wherein the first removable insert comprises a first portion and a second portion, and wherein the first portion and the second portion have different properties.

31. The method recited in claim 30, wherein the first portion comprises approximately 50% of the first removable insert.

32. The method recited in claim 30, wherein the first portion is a wedge that tapers from the lateral side of the first removable insert toward a center region of the first removable insert and the second portion is a wedge that tapers from the medial side of the first removable insert toward the center region, such that the center region comprises both the first portion and the second portion.

33. The method recited in claim 16, wherein the recording the information step is performed by a wearer of the article of footwear.

34. A method of comparing removable inserts used during an athletic activity, comprising:

providing to a first tester an article of footwear having a first removable insert that is inserted into a sole structure of the article of footwear, the first removable insert having a first set of characteristics;

instructing the first tester to perform at least one athletic activity while wearing the article of footwear with the first removable insert inserted into the sole structure;

instructing the first tester to provide a first descriptive analysis of the performance of the first removable insert during the at least one athletic activity with respect to the first set of characteristics;

providing to the first tester the article of footwear having a reference removable insert that is inserted into the sole structure of the article of footwear, the reference removable insert having a reference set of characteristics that are different from the first set of characteristics, each of the reference characteristics having a value that is a value on a scale, the scale and value being assigned by another party;

instructing the first tester to perform the at least one athletic activity while wearing the article of footwear with the reference removable insert inserted into the sole structure;

instructing the first tester compare the first set of characteristics to the reference set of characteristics and assign values for the first characteristics on the scale;

instructing the first tester to provide a second descriptive analysis of the performance of the reference removable insert during the at least one athletic activity; and recording information in a tangible medium of expression relating to an objective analysis comparing the first descriptive analysis with the second descriptive analysis and the scaled values of the first characteristics and the reference characteristics.

35. The method recited in claim 34, wherein the step of recording information includes:

comparing the first descriptive analysis with a first standardized descriptive analysis of the first removable insert; and comparing the second descriptive analysis with a second standardized descriptive analysis of the reference removable insert.

36. The method recited in claim 35, further comprising assigning a rating to the first tester based at least in part on the comparison of the first descriptive analysis with the first standardized descriptive analysis and the comparison of the second descriptive analysis with the second standardized descriptive analysis.

37. The method recited in claim 36, further comprising: selecting the first tester for inclusion in a product test group of articles of footwear, wherein the selection is based at least in part on the rating assigned to the first tester.

38. The method recited in claim 34, wherein the first descriptive analysis includes information relating to at least one of: resilience, hardness, stability, support, and grip of the article of footwear.

39. The method recited in claim 34, further comprising:

providing the first tester with the reference removable insert and a reference descriptive analysis that is based on the performance of the reference removable insert during the athletic activity;

instructing the first tester to perform the at least one athletic activity while wearing the article of footwear containing the sole structure with the reference removable insert; and instructing the first tester to use the reference descriptive analysis as a reference upon which to base the first descriptive analysis and the second descriptive analysis.

* * * * *